US012509751B2

(12) United States Patent
Lee et al.

(10) Patent No.: US 12,509,751 B2
(45) Date of Patent: Dec. 30, 2025

(54) HIGH STRENGTH STEEL SHEET HAVING EXCELLENT WORKABILITY AND METHOD FOR MANUFACTURING SAME

(71) Applicant: POSCO CO., LTD, Pohang-si (KR)

(72) Inventors: Jae-Hoon Lee, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 371 days.

(21) Appl. No.: 18/267,435

(22) PCT Filed: Dec. 1, 2021

(86) PCT No.: PCT/KR2021/017997
§ 371 (c)(1),
(2) Date: Jun. 14, 2023

(87) PCT Pub. No.: WO2022/131628
PCT Pub. Date: Jun. 23, 2022

(65) Prior Publication Data

US 2024/0026504 A1 Jan. 25, 2024

(30) Foreign Application Priority Data

Dec. 17, 2020 (KR) ..... 10-2020-0177629

(51) Int. Cl.

| | |
|---|---|
| ***C22C 38/04*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |

(52) U.S. Cl.
CPC ..... *C22C 38/04* (2013.01); *C21D 8/0226* (2013.01); *C21D 8/0236* (2013.01); *C21D 8/0273* (2013.01); *C21D 8/0278* (2013.01); *C21D 9/46* (2013.01); *C22C 38/002* (2013.01); *C22C 38/02* (2013.01); *C22C 38/06* (2013.01); *C21D 2211/001* (2013.01); *C21D 2211/002* (2013.01); *C21D 2211/008* (2013.01)

(58) Field of Classification Search
CPC ..... C22C 38/04; C22C 38/002; C22C 38/02; C22C 38/06; C22C 38/005; C22C 38/008; C22C 38/10; C22C 38/12; C22C 38/14; C22C 38/16; C22C 38/22; C22C 38/32; C22C 38/38; C22C 38/60; C22C 38/001; C21D 8/0226; C21D 8/0236; C21D 8/0273; C21D 8/0278; C21D 9/46; C21D 2211/001; C21D 2211/002; C21D 2211/008; C21D 1/19; C21D 1/20; C21D 1/25; C21D 1/26; C21D 1/84; C21D 8/0263; C21D 8/0463; C21D 6/005; C21D 8/0426; C21D 8/0436; C21D 8/0473; C21D 9/48; C21D 8/0247; Y02P 10/20
See application file for complete search history.

(56) References Cited

U.S. PATENT DOCUMENTS

| | | | |
|---|---|---|---|
| 10,174,396 | B2 | 1/2019 | Takashima et al. |
| 10,724,114 | B2 | 7/2020 | Yokoyama et al. |
| 11,390,930 | B2 | 7/2022 | Ono et al. |
| 2007/0190353 | A1 | 8/2007 | Taniguchi et al. |
| 2012/0312433 | A1 | 12/2012 | Mizuta et al. |
| 2014/0170439 | A1 | 6/2014 | Allain et al. |
| 2017/0335423 | A1 | 11/2017 | Murakami et al. |
| 2020/0190619 | A1 | 6/2020 | Natsumeda et al. |
| 2020/0316807 | A1 | 10/2020 | Föjer et al. |
| 2021/0087646 | A1 | 3/2021 | Jung et al. |
| 2021/0381077 | A1 | 12/2021 | Kohsaka et al. |

FOREIGN PATENT DOCUMENTS

| | | | |
|---|---|---|---|
| EP | 3101147 | B1 | 8/2018 |
| EP | 3611285 | A1 | 2/2020 |
| EP | 3859041 | A1 | 8/2021 |
| JP | 2008214752 | A | 9/2008 |
| JP | 2009019258 | A | 1/2009 |
| JP | 2013019047 | A | 1/2013 |
| JP | 2016098413 | A | 5/2016 |
| JP | 2016180139 | A | 10/2016 |
| JP | 2016216808 | A | 12/2016 |
| JP | 2017214648 | A | 12/2017 |
| KR | 20060118602 | A | 11/2006 |

(Continued)

OTHER PUBLICATIONS

Chinese Office Action—Chinese Application No. 202180085320.X issued on Mar. 7, 2025, citing JP 2013-019047, JP 2016-180139, KR 2020-0036759, KR 2020-0075958, US 2020/0316807, and WO 2018/221307.

International Search Report—PCT/KR2021/017997 dated Mar. 10, 2022.

European Search Report—European Application No. 21906933.3 issued on Jun. 4, 2024, citing EP 3 101 147, EP 3 611 285, US 2020/0316807, and KR 10-2020-0075958.

(Continued)

*Primary Examiner* — Adil A. Siddiqui

(74) *Attorney, Agent, or Firm* — CANTOR COLBURN LLP

(57) ABSTRACT

Provided is a steel sheet that may be used for automobile parts and the like, and to a steel sheet having an excellent balance of strength and ductility, an excellent balance of strength and hole expansion ratio, and an excellent yield ratio evaluation index, and a method for manufacturing the same. The steel sheet includes: by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities; and as microstructures, bainite, tempered martensite, fresh martensite, retained austenite and unavoidable structures.

8 Claims, No Drawings

(56) References Cited

FOREIGN PATENT DOCUMENTS

| | | | |
|---|---|---|---|
| KR | 20140012167 | A | 1/2014 |
| KR | 20200003010 | A | 1/2020 |
| KR | 20200036759 | A | 4/2020 |
| KR | 20200075958 | A | 6/2020 |
| KR | 20200076795 | A | 6/2020 |
| KR | 20200084037 | A | 7/2020 |
| KR | 102178731 | B | 11/2020 |
| WO | 2017002883 | A1 | 1/2017 |
| WO | 2018221307 | A1 | 12/2018 |
| WO | 2020080339 | A1 | 4/2020 |
| WO | 2020104437 | A1 | 5/2020 |

OTHER PUBLICATIONS

Japanese Office Action—Japanese Application No. 2023-536981 issued on Jul. 2, 2024, citing WO 2017/002883, JP 2017-214648, JP 2016-098413, WO 2020/080339, WO 2020/104437, and KR 10-2020-0076795.

HIGH STRENGTH STEEL SHEET HAVING EXCELLENT WORKABILITY AND METHOD FOR MANUFACTURING SAME

TECHNICAL FIELD

The present invention relates to a steel sheet that may be used for automobile parts and the like, and to a steel sheet having high strength characteristics and excellent workability and a method for manufacturing the same.

BACKGROUND ART

In recent years, the automobile industry has been paying attention to ways to reduce material weight in an effort to protect the global environment and secure occupant safety. In order to meet these requirements for safety and weight reduction, the use of a high strength steel sheet is rapidly increasing. In general, it is commonly known that as the strength of the steel sheet increases, the workability of the steel sheet is lowered. Therefore, in a steel sheet for automobile parts, a steel sheet having excellent workability represented by ductility, a hole expansion ratio, and the like, while having high strength characteristics is required.

Since transformation induced plasticity (TRIP) steel, using transformation-induced plasticity of retained austenite, has a complex microstructure consisting of ferrite, bainite, martensite, retained austenite, and the like, it is known as having a certain level or more of workability, as well as high strength characteristics.

As a technique for further improving the workability of a steel sheet, a method of utilizing tempered martensite is disclosed in Patent Documents 1 and 2. Since tempered martensite made by tempering hard martensite is softened martensite, there is a difference in strength between tempered martensite and existing untempered martensite (fresh martensite). Therefore, when fresh martensite is suppressed and tempered martensite is formed, the workability may increase.

However, by the techniques disclosed in Patent Documents 1 and 2, a balance ($TS^2*EL^{1/2}$) of tensile strength and elongation does not satisfy the range of $3.0*10^6$ to $6.2*10^6$ ($MPa^2\%^{1/2}$), meaning that it is difficult to secure a steel sheet having both of excellent strength and excellent ductility.

Meanwhile, as another technique for improving workability of a steel sheet, Patent Document 3 discloses a method for inducing generation of bainite by means of adding boron (B). In the case of adding boron (B), a ferrite-pearlite transformation is suppressed, while generation of bainite is induced, whereby coexistence of strength and workability can be achieved.

However, by the technique disclosed in Patent Document 3, a balance ($B_{TE}$) of tensile strength and elongation of $3.0*10^6$ to $6.2*10^6$ ($MPa^2\%^{1/2}$), a balance ($B_{TH}$) of tensile strength and a hole expansion ratio of $6.0*10^6$ to $11.5*10^6$ ($MPa^2\%^{1/2}$), and a yield ratio evaluation index ($I_{YR}$) of 0.15 to 0.42 cannot be secured at the same time, thereby meaning it is difficult to secure a steel sheet having all of excellent strength, an excellent hole expansion ratio, excellent ductility, and an excellent yield ratio.

That is, a demand for a steel sheet having all of an excellent balance ($B_{TE}$) of tensile strength and elongation, an excellent balance ($B_{TH}$) of tensile strength and a hole expansion ratio, and an excellent yield ratio evaluation index ($I_{YR}$) is not satisfied.

RELATED ART DOCUMENT (Patent Document 1) Korean Laid-Open Patent Publication No. 10-2006-0118602

(Patent Document 2) Japanese Laid-Open Patent Publication No. 2009-019258

(Patent Document 3) Japanese Laid-Open Patent Publication No. 2016-216808

DISCLOSURE

Technical Problem

According to an aspect of the present invention, a steel sheet having all of an excellent balance of tensile strength and elongation, an excellent balance of tensile strength and a hole expansion ratio, and an excellent yield ratio evaluation index and a method manufacturing the same can be provided, by optimizing a composition and microstructures of the steel sheet.

An object of the present invention is not limited to the abovementioned contents. Additional objects of the present invention are described in the overall content of the specification, and those of ordinary skill in the art to which the present invention pertains will have no difficulty in understanding the additional objects of the present invention from the contents described in the specification of the present invention.

Technical Solution

In an aspect of the present invention, a high strength steel sheet having excellent workability may comprise: by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities; and as microstructures, bainite, tempered martensite, fresh martensite, retained austenite and unavoidable structures, wherein the high strength steel sheet may satisfy the following relational expressions 1 to 4:

$$0.03 \le [B]_{FM}/[B]_{TM} \le 0.55 \quad \text{[Relational Expression 1]}$$

where $[B]_{FM}$ is a content (wt %) of boron (B) contained in the fresh martensite, and $[B]_{TM}$ is a content (wt %) of boron (B) contained in the tempered martensite;

$$V(1.2\ \mu m,\gamma)/V(\gamma) \ge 0.12 \quad \text{[Relational Expression 2]}$$

where V(1.2 μm, γ) is a fraction (vol %) of the retained austenite having an average grain size of 1.2 μm or more, and V(γ) is a fraction (vol %) of the retained austenite of the steel sheet;

$$V(\text{lath},\gamma)/V(\gamma) \ge 0.5 \quad \text{[Relational Expression 3]}$$

where V(lath, γ) is a fraction (vol %) of the retained austenite in lath form, and V(γ) is a fraction (vol %) of the retained austenite of the steel sheet; and $$T(\gamma)/V(\gamma) \ge 0.08 \quad \text{[Relational Expression 4]}$$

where T(γ) is a fraction (vol %) of tempered retained austenite of the steel sheet, and V(γ) is a fraction (vol %) of the retained austenite of the steel sheet.

The steel sheet may further comprise, by wt %, one or more of the following (1) to (8):

(1) one or more of Ti: 0 to 0.5%, Nb: 0 to 0.5%, and V: 0 to 0.5%;
(2) one or more of Cr: 0 to 3.0% and Mo: 0 to 3.0%;
(3) one or more of Cu: 0 to 4.0% and Ni: 0 to 4.0% (4) one or more of Ca: 0 to 0.05%, REM: 0 to 0.05% excluding Y, and Mg: 0 to 0.05%;
(5) one or more of W: 0 to 0.5% and Zr: 0 to 0.5%;
(6) one or more of Sb: 0 to 0.5% and Sn: 0 to 0.5%;
(7) one or more of Y: 0 to 0.2% and Hf: 0 to 0.2%; and
(8) Co: 0 to 1.5%.

The microstructures of the steel sheet may include, by volume fraction, 10 to 30% of bainite, 50 to 70% of tempered martensite, 10 to 30% of fresh martensite, 2 to 10% of retained austenite, and 5% or less (including 0%) of ferrite.

In the steel sheet, a balance ($B_{TE}$) of tensile strength and elongation expressed by the following relational expression 5 satisfies $3.0*10^6$ to $6.2*10^6$ ($MPa^2\%^{1/2}$), a balance ($B_{TH}$) of tensile strength and a hole expansion ratio expressed by the following relational 6 expression satisfies $6.0*10^6$ to $11.5*10^6$ ($MPa^2\%^{1/2}$), and a yield ratio evaluation index ($I_{YR}$) expressed by the following relational expression 7 satisfies 0.15 to 0.42:

$$B_{TE}=[\text{Tensile Strength } (TS,MPa)]^2*[\text{Elongation } (El,\%)]^{1/2}; \quad \text{[Relational Expression 5]}$$

$$B_{TH}=[\text{Tensile Strength } (TS,MPa)]^2*[\text{Hole Expansion Ratio } (HER,\%)]^{1/2}; \text{ and} \quad \text{[Relational Expression 6]}$$

$$I_{YR}=1-[\text{Yield Ratio } (YR)]. \quad \text{[Relational Expression 7]}$$

In an aspect of the present invention, a method for manufacturing a high strength steel sheet having excellent workability may comprise: providing a cold-rolled steel sheet including, by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities; heating (primarily heating) the cold-rolled steel sheet to a temperature of 700° C. at an average heating rate of 5° C./s or more, heating (secondarily heating) the primarily heated steel sheet to a temperature within a range of Ac3 to 920° C. at an average heating rate of 5° C./s or less, and then maintaining (primarily maintaining) the secondarily heated steel sheet for 50 to 1200 seconds; cooling (primarily cooling) the primarily maintained steel sheet to a temperature within a range of 400 to 600° C. at an average cooling rate of 2 to 100° C./s, and then maintaining (secondarily maintaining) the primarily cooled steel sheet for 5 to 600 seconds; cooling (secondarily cooling) the secondarily maintained steel sheet to a temperature within a range of 300 to 500° C. at an average cooling rate of 1 to 100° C./s, and then maintaining (tertiarily maintaining) the secondarily cooled steel sheet for 5 to 600 seconds; cooling (tertiarily cooling) the tertiarily maintained steel sheet to a temperature within a range of 200 to 400° C. at an average cooling rate of 2 to 100° C./s; heating (tertiarily heating) the tertiarily cooled steel sheet to a temperature within a range of 400 to 600° C. at an average heating rate of 5 to 100° C./s, and then maintaining (quaternarily maintaining) the tertiarily heated steel sheet for 10 to 1800 seconds; cooling (quaternarily cooling) the quaternarily maintained steel sheet to a temperature within a range of 300 to 500° C. at an average cooling rate of 1 to 100° C./s, and then maintaining (quintically maintaining) the quaternarily cooled steel sheet for 10 to 1800 seconds; and cooling (quintically cooling) the quintically maintained steel sheet to room temperature at an average cooling rate of 1° C./s or more.

The steel slab may further comprise, by wt %, one or more of the following (1) to (8):

(1) one or more of Ti: 0 to 0.5%, Nb: 0 to 0.5%, and V: 0 to 0.5%;
(2) one or more of Cr: 0 to 3.0% and Mo: 0 to 3.0%;
(3) one or more of Cu: 0 to 4.0% and Ni: 0 to 4.0%
(4) one or more of Ca: 0 to 0.05%, REM: 0 to 0.05% excluding Y, and Mg: 0 to 0.05%;
(5) one or more of W: 0 to 0.5% and Zr: 0 to 0.5%;
(6) one or more of Sb: 0 to 0.5% and Sn: 0 to 0.5%;
(7) one or more of Y: 0 to 0.2% and Hf: 0 to 0.2%; and
(8) Co: 0 to 1.5%.

The cold-rolled steel sheet may be provided by: heating a steel slab to 1000 to 1350° C.; performing finishing hot rolling at a temperature within a range of 800 to 1000° C.; coiling the hot-rolled steel sheet at a temperature within a range of 350 to 600° C.; pickling the coiled steel sheet; and cold rolling the pickled steel sheet at a reduction ratio of 30 to 90%.

The cooling rate (Vc1) of the primary cooling and the cooling rate (Vc4) of the quaternary cooling may satisfy a relation of Vc1>Vc4.

Advantageous Effects

According to an aspect of the present invention, it is possible to provide a steel sheet that may be used for automobile parts and the like, and to a steel sheet having an excellent balance of tensile strength and ductility, an excellent balance of tensile strength and hole expansion ratio, and an excellent yield ratio evaluation index, and a method for manufacturing the same.

BEST MODE

The present invention relates to a high strength steel sheet having excellent workability and a method for manufacturing the same, and exemplary embodiments of the present invention will hereinafter be described. Exemplary embodiments of the present invention may be modified into various forms, and it is not to be interpreted that the scope of the present invention is limited to exemplary embodiments described below. The present exemplary embodiments are provided in order to further describe the present invention in detail to those skilled in the art to which the present invention pertains.

The inventors of the present invention recognized that in a boron(B)-added transformation-induced plasticity (TRIP) steel comprising bainite, tempered martensite, fresh martensite and retained austenite, when the fractions of the tempered martensite, the fresh martensite, and the retained austenite are controlled to be within certain ranges, the contents of the boron (B) contained in the tempered martensite and the fresh martensite are controlled to be within certain ranges, and a shape and a size of the retained austenite are controlled to be within certain ranges, it is possible to simultaneously secure an excellent balance of tensile strength and ductility, an excellent balance of tensile strength and a hole expansion ratio, and an excellent yield ratio evaluation index. Based thereon, the present inventors have conceived of the present invention by devising a method such that excellent strength, excellent yield ratio, excellent ductility, and an excellent hole expansion ratio may be simultaneously provided.

Hereinafter, a high strength steel sheet having excellent workability according to an aspect of the present invention will be described in more detail.

In an aspect of the present invention, a high strength steel sheet having excellent workability may comprise: by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities; and as microstructures, bainite, tempered martensite, fresh martensite, retained austenite and unavoidable structures, wherein the high strength steel sheet may satisfy the following relational expressions 1 to 4:

$$0.03 \le [B]_{FM}/[B]_{TM} \le 0.55 \quad \text{[Relational Expression 1]}$$

where $[B]_{FM}$ is a content (wt %) of boron (B) contained in the fresh martensite, and $[B]_{TM}$ is a content (wt %) of boron (B) contained in the tempered martensite;

$$V(1.2\ \mu m,\gamma)/V(\gamma) \geq 0.12 \quad \text{[Relational Expression 2]}$$

where V(1.2 μm, γ) is a fraction (vol %) of the retained austenite having an average grain size of 1.2 μm or more, and V(γ) is a fraction (vol %) of the retained austenite of the steel sheet;

$$V(\text{lath},\gamma)/V(\gamma) \geq 0.5 \quad \text{[Relational Expression 3]}$$

where V(lath, γ) is a fraction (vol %) of the retained austenite in lath form, and V(γ) is a fraction (vol %) of the retained austenite of the steel sheet; and $$T(\gamma)/V(\gamma) \geq 0.08 \quad \text{[Relational Expression 4]}$$

where T(γ) is a fraction (vol %) of tempered retained austenite of the steel sheet, and V(γ) is a fraction (vol %) of the retained austenite of the steel sheet.

Hereinafter, compositions of steel according to the present invention will be described in more detail. Hereinafter, unless otherwise indicated, % indicating a content of each element is based on weight.

The high strength steel sheet having excellent workability according to an aspect of the present invention includes: by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities. In addition, the high strength steel sheet may further include one or more of Ti: 0.5% or less (including 0%), Nb: 0.5% or less (including 0%), V: 0.5% or less (including 0%), Cr: 3.0% or less (including 0%), Mo: 3.0% or less (including 0%), Cu: 4.0% or less (including 0%), Ni: 4.0% or less (including 0%), Ca: 0.05% or less (including 0%), REM: 0.05% or less (including 0%) excluding Y, Mg: 0.05% or less (including 0%), W: 0.5% or less (including 0%), Zr: 0.5% or less (including 0%), Sb: 0.5% or less (including 0%), Sn: 0.5% or less (including 0%), Y: 0.2% or less (including 0%), Hf: 0.2% or less (including 0%), and Co: 1.5% or less (including 0%).

Carbon (C): 0.1 to 0.25%

Carbon (C) is an unavoidable element for securing strength of a steel sheet, and is also an element for stabilizing retained austenite that contributes to the improvement in ductility of the steel sheet. Accordingly, in the present invention, 0.1% or more of carbon (C) may be added in order to achieve such an effect. A preferable content of carbon (C) may be greater than 0.1%, may be 0.11% or more, and may be 0.12% or more. On the other hand, when the content of carbon (C) exceeds a certain level, ductility may be lowered and weldability may be degraded due to an excessive increase in strength. Therefore, an upper limit of the content of carbon (C) of the present invention may be limited to 0.25%. The content of carbon (C) may be 0.24% or less, and a more preferable content of carbon (C) may be 0.23% or less.

Silicon (Si): 0.01 to 1.5% or Less

Silicon (Si) is an element that contributes to improvement in strength by solid solution strengthening, and is also an element improving workability by homogenizing a structure. In addition, silicon (Si) is an element contributing to generation of retained austenite by suppressing precipitation of cementite. Therefore, in the present invention, silicon (Si) of 0.01% or more may be added in order to achieve such an effect. A preferable content of silicon (Si) may be 0.02% or more, and a more preferable content of silicon (Si) may be 0.04% or more. However, when the content of silicon (Si) exceeds a certain level, a problem of plating defects, such as non-plating, may be induced during plating, and weldability of a steel sheet may be lowered, so the present invention may limit an upper limit of the content of silicon (Si) to 1.5%. A preferable upper limit of the content of silicon (Si) may be 1.48%, and a more preferable upper limit of the content of silicon (Si) may be 1.46%.

Manganese (Mn): 1.0 to 4.0%

Manganese (Mn) is a useful element for increasing both strength and ductility. Therefore, in the present invention, manganese (Mn) of 1.0% or more may added in order to achieve such an effect. A preferable lower limit of the content of manganese (Mn) may be 1.2%, and a more preferable lower limit of the content of manganese (Mn) may be 1.4%. On the other hand, when manganese (Mn) is excessively added, a bainite transformation time increases and concentration of carbon (C) in austenite becomes insufficient, so there exists a problem in which a desired austenite fraction may not be secured. Therefore, in the present invention, an upper limit of the content of manganese (Mn) of the present invention may be limited to 4.0%. A preferable upper limit of the content of manganese (Mn) may be 3.9%.

Aluminum (Al): 0.01 to 1.5%

Aluminum (Al) is an element performing deoxidation by combining with oxygen in steel. In addition, aluminum (Al) is also an element for stabilizing retained austenite by suppressing precipitation of cementite like silicon (Si). Therefore, in the present invention, aluminum (Al) of 0.01% or more may be added in order to achieve such an effect. A preferable content of aluminum (Al) may be 0.03% or more, and a more preferable content of aluminum (Al) may be 0.05% or more. On the other hand, when aluminum (Al) is excessively added, inclusions in a steel sheet increase, and workability of the steel sheet may be lowered, so the present invention may limit an upper limit of the content of aluminum (Al) to 1.5%. A preferable upper limit of the content of aluminum (Al) may be 1.48%.

Phosphorus (P): 0.15% or Less (Including 0%)

Phosphorus (P) is an element which is contained as an impurity and deteriorates impact toughness. Therefore, it is preferable to manage the content of phosphorus (P) to 0.15% or less.

Sulfur (S): 0.03% or Less (Including 0%)

Sulfur (S) is an element which is contained as an impurity to form MnS in a steel sheet and deteriorate ductility. Therefore, it is preferable that the content of sulfur (S) is 0.03% or less.

Nitrogen (N): 0.03% or Less (Including 0%)

Nitrogen (N) is an element which is contained as an impurity and forms nitride during continuous casting to cause cracks in a slab. Therefore, it is preferable that the content of nitrogen (N) is 0.03% or less.

Boron (B): 0 to 0.005%

Boron (B) is an element improving hardenability to increase strength, and is also an element suppressing nucleation of grain boundaries. In addition, in the present invention, it is intended to simultaneously secure an excellent balance of tensile strength and elongation, an excellent balance of tensile strength and a hole expansion ratio, and an excellent yield ratio evaluation index, and therefore, boron (B) is to be necessarily added in the present invention. Therefore, in the present invention, 0.0005% or more of boron (B) may be added in order to achieve such an effect. However, when the content of boron (B) is added beyond a certain level, not only excessive characteristic effects, but also an increase in manufacturing costs is incurred, so the present invention may limit an upper limit of the content of boron (B) to 0.005%.

Meanwhile, the steel sheet of the present invention has an alloy composition that may be additionally included in addition to the above-described alloy components, which will be described in detail below.

One or More of Titanium (Ti): 0 to 0.5%, Niobium (Nb): 0 to 0.5%, and Vanadium (V): 0 to 0.5%

Titanium (Ti), niobium (Nb), and vanadium (V) are elements that make precipitates and refine crystal grains, and are elements that also contribute to the improvement in strength and impact toughness of a steel sheet, and therefore, in the present invention, one or more of titanium (Ti), niobium (Nb), and vanadium (V) may be added in order to achieve such an effect. However, when each of the contents of titanium (Ti), niobium (Nb), and vanadium (V) exceeds a certain level, excessive precipitates are formed to lower impact toughness and increase manufacturing costs, so the present invention may limit the contents of titanium (Ti), niobium (Nb), and vanadium (V) to 0.5% or less, respectively.

One or More of Chromium (Cr): 0 to 3.0% and Molybdenum (Mo): 0 to 3.0%

Since chromium (Cr) and molybdenum (Mo) are elements that not only suppress austenite decomposition during alloying treatment, but also stabilize austenite like manganese (Mn), in the present invention, one or more of chromium (Cr) and molybdenum (Mo) may be added in order to achieve such an effect. However, when the contents of chromium (Cr) and molybdenum (Mo) exceed certain levels, the bainite transformation time increases and the concentration of carbon (C) in austenite becomes insufficient, so the desired retained austenite fraction may not be secured. Therefore, the present invention may limit the contents of chromium (Cr) and molybdenum (Mo) to 3.0% or less, respectively.

One or More of Cu: 0 to 4.0% and Ni: 0 to 4.0%

Copper (Cu) and nickel (Ni) are elements that stabilize austenite and suppress corrosion. In addition, copper (Cu) and nickel (Ni) are also elements that are concentrated on a surface of a steel sheet to prevent hydrogen from intruding into the steel sheet, thereby suppressing hydrogen delayed destruction. Therefore, in the present invention, one or more of copper (Cu) and nickel (Ni) may be added in order to achieve such an effect. However, when the contents of copper (Cu) and nickel (Ni) exceed certain levels, not only excessive characteristic effects, but also an increase in manufacturing costs is incurred, so the present invention may limit the contents of copper (Cu) and nickel (Ni) to 4.0% or less, respectively.

One or More of Calcium (Ca): 0 to 0.05%, Magnesium (Mg): 0 to 0.05%, and Rare Earth Element (REM) Excluding Yttrium (Y): 0 to 0.05%

Here, the rare earth element (REM) is scandium (Sc), yttrium (Y), and a lanthanide element. Since calcium (Ca), magnesium (Mg), and the rare earth element (REM) excluding yttrium (Y) are elements that contribute to the improvement in ductility of a steel sheet by spheroidizing sulfides, in the present invention, one or more of calcium (Ca), magnesium (Mg), and the rare earth element (REM) excluding yttrium (Y) may be added in order to achieve such an effect. However, when the contents of calcium (Ca), magnesium (Mg), and the rare earth element (REM) excluding yttrium (Y) exceed certain levels, not only excessive characteristic effects, but also an increase in manufacturing costs is incurred, so the present invention may limit the contents of calcium (Ca), magnesium (Mg), and the rare earth element (REM) excluding yttrium (Y) to 0.05% or less, respectively.

One or More of Tungsten (W): 0 to 0.5% and Zirconium (Zr): 0 to 0.5%

Since tungsten (W) and zirconium (Zr) are elements that increase strength of a steel sheet by improving hardenability, in the present invention, one or more of tungsten (W) and zirconium (Zr) may be added in order to achieve such an effect. However, when the contents of tungsten (W) and zirconium (Zr) exceed certain levels, not only excessive characteristic effects, but also an increase in manufacturing costs is incurred, so the present invention may limit the contents of tungsten (W) and zirconium (Zr) to 0.5% or less, respectively.

One or More of Antimony (Sb): 0 to 0.5% and Tin (Sn): 0 to 0.5%

Since antimony (Sb) and tin (Sn) are elements that improve plating wettability and plating adhesion of a steel sheet, in the present invention, one or more of antimony (Sb) and tin (Sn) may be added in order to achieve such an effect.

However, when the contents of antimony (Sb) and tin (Sn) exceed certain levels, brittleness of a steel sheet increases, and thus, cracks may occur during hot working or cold working, so the present invention may limit the contents of antimony (Sb) and tin (Sn) to 0.5% or less, respectively.

One or More of Yttrium (Y): 0 to 0.2% and Hafnium (Hf): 0 to 0.2%

Since yttrium (Y) and hafnium (Hf) are elements that improve corrosion resistance of a steel sheet, in the present invention, one or more of the yttrium (Y) and hafnium (Hf) may be added in order to achieve such an effect. However, when the contents of yttrium (Y) and hafnium (Hf) exceed certain levels, ductility of the steel sheet may deteriorate, so the present invention may limit the contents of yttrium (Y) and hafnium (Hf) to 0.2% or less, respectively.

Cobalt (Co): 0 to 1.5%

Since cobalt (Co) is an element that promotes a bainite transformation to increase a TRIP effect, in the present invention, cobalt (Co) may be added in order to achieve such an effect. However, when the content of cobalt (Co) exceeds a certain level, since weldability and ductility of a steel sheet may deteriorate, the present invention may limit the content of cobalt (Co) to 1.5% or less.

The high strength steel sheet having excellent workability according to an aspect of the present invention may include a balance of Fe and other unavoidable impurities in addition to the components described above. However, in a general manufacturing process, unintended impurities may inevitably be mixed from raw materials or the surrounding environment, and thus, these impurities may not be completely excluded. Since these impurities are known to those skilled in the art, all the contents are not specifically mentioned in the present specification. In addition, a further addition of effective components other than the above-described components is not entirely excluded.

The high strength steel sheet having excellent workability according to an aspect of the present invention may include, as microstructures, bainite, tempered martensite, fresh martensite, retained austenite and unavoidable structures.

Both untempered martensite (fresh martensite, FM) and tempered martensite (TM) are microstructures that improve the strength of a steel sheet. However, compared with tempered martensite, fresh martensite has a characteristic of greatly reducing ductility and burring workability of a steel sheet. In addition, compared with tempered martensite, fresh martensite has a tendency of reducing a yield ratio of a steel sheet. These are because a microstructure of tempered martensite is softened by a tempering heat treatment. Therefore, in the present invention, it is preferable to control fractions of tempered martensite and fresh martensite in order to secure a balance ($TS^2*EL^{1/2}$) of tensile strength and elongation, a balance ($TS^2*HER^{1/2}$) of tensile strength and a hole expansion ratio, and a yield ratio evaluation index (1-YR) targeted by the present invention. In order to satisfy a balance ($TS^2*EL^{1/2}$) of tensile strength and elongation of $3.0*10^6$ or more, a balance ($TS^2*HER^{1/2}$) of tensile strength and a hole expansion ratio of $6.0*10^6$ or more, and a yield ratio evaluation index (1-YR) of 0.42 or less, it is preferable to limit a fraction of the tempered martensite to 50 vol % or more, and to limit a fraction of the fresh martensite to 10 vol % or more. A more preferable fraction of tempered martensite may be 52 vol % or more, or 54 vol % or more, and a more preferable fraction of fresh martensite may be 12 vol % or more. On the other end, when tempered martensite or fresh martensite is excessively formed, ductility and burring workability are lowered, so that a balance ($TS^2*EL^{1/2}$) of tensile strength and elongation of $3.0*10^6$ or more, a balance ($TS^2*HER^{1/2}$) of tensile strength and a hole expansion ratio of $6.0*10^6$ or more, and a yield ratio evaluation index (1-YR) of 0.42 or less cannot be satisfied at the same time. Therefore, the present invention may limit a fraction of tempered martensite to 70 vol % or less, and limit a fraction of fresh martensite to 30 vol % or less. A more preferable fraction of tempered martensite may be 68 vol % or less, or 65 vol % or less, and more preferable fraction of fresh martensite may be 25 vol % or less.

It is necessary to optimize a fraction of bainite in order to secure a balance ($TS^2*EL^{1/2}$) of tensile strength and elongation, a balance ($TS^2*HER^{1/2}$) of tensile strength and a hole expansion ratio, and a yield ratio evaluation index (1-YR) at levels targeted by the present invention. In order to secure a balance ($TS^2*EL^{1/2}$) of tensile strength and elongation of $3.0*10^6$ or more, a balance ($TS^2*HER^{1/2}$) of tensile strength and a hole expansion ratio of $6.0*10^6$ or more, and a yield ratio evaluation index (1-YR) of 0.42 or less, it is preferable to control a fraction of bainite to 10 vol % or more. A more preferable fraction of bainite may be 12 vol % or more, or 14 vol % or more. On the other end, when bainite is excessively formed, it causes a fraction reduction of tempered martensite, so that a fraction of bainite may be limited to 30 vol % or less, in order to secure a balance ($TS^2*EL^{1/2}$) of tensile strength and elongation, a balance ($TS^2*HER^{1/2}$) of tensile strength and a hole expansion ratio, and a yield ratio evaluation index (1-YR) targeted by the present invention. A preferable fraction of the bainite may be 12 vol % or more, 14 vol % or more, 28 vol % or less, or 26 vol % or less.

A steel sheet including retained austenite has excellent ductility and bending workability due to transformation-induced plasticity occurring during transformation from austenite to martensite during processing. When a fraction of the retained austenite is lower than a certain level, a balance ($TS^2*EL^{1/2}$) of tensile strength and elongation may be less than $3.0*10^6$ ($MPa^2\%^{1/2}$), and is not preferably. On the other hand, when a fraction of retained austenite exceeds a certain level, local elongation may be lowered, or point weldability may be lowered. Therefore, in the present invention, a fraction of retained austenite may be limited to be in a range of 2 to 10 vol % in order to obtain a steel sheet having an excellent balance ($TS^2*EL^{1/2}$) of tensile strength and elongation. A preferable fraction of retained austenite is 3 vol % or more, or 8 vol % or less.

As the unavoidable structure, the steel sheet of the present invention may include ferrite, pearlite, martensite austenite constituent (M-A), and the like. When ferrite is excessively formed, strength of the steel sheet may be lowered, so the present invention may limit a fraction of ferrite to 5 vol % (including 0%). Moreover, when pearlite is excessively formed, workability of the steel sheet may be lowered or a fraction of retained austenite may be lowered, so the present invention intends to limit the formation of pearlite as much as possible.

The high strength steel sheet having excellent workability according to an aspect of the present invention may satisfy the following relational expressions 1 to 4:

$$0.03 \le [B]_{FM}/[B]_{TM} \le 0.55 \quad \text{[Relational Expression 1]}$$

where $[B]_{FM}$ is a content (wt %) of boron (B) contained in the fresh martensite, and $[B]_{TM}$ is a content (wt %) of boron (B) contained in the tempered martensite;

$$V(1.2\ \mu m, \gamma)/V(\gamma) \ge 0.12 \quad \text{[Relational Expression 2]}$$

where V(1.2 μm, γ) is a fraction (vol %) of the retained austenite having an average grain size of 1.2 μm or more, and V(γ) is a fraction (vol %) of the retained austenite of the steel sheet;

$$V(\text{lath}, \gamma)/V(\gamma) \ge 0.5 \quad \text{[Relational Expression 3]}$$

where V(lath, γ) is a fraction (vol %) of the retained austenite in lath form, and V(γ) is a fraction (vol %) of the retained austenite of the steel sheet; and $$T(\gamma)/V(\gamma) \ge 0.08 \quad \text{[Relational Expression 4]}$$

where T(γ) is a fraction (vol %) of tempered retained austenite of the steel sheet, and V(γ) is a fraction (vol %) of the retained austenite of the steel sheet.

The present invention not only controls the fractions of the tempered martensite, the fresh martensite, and the retained austenite to be in certain ranges, but also controls the content ratios of the boron (B) contained in the tempered martensite, and the fresh martensite to be in certain ranges, while controlling a ratio of the retained austenite of specific size, shape and type with respect to the entire retained austenite to be in a certain range, in order to secure a balance ($TS^2*EL^{1/2}$) of tensile strength and elongation, a balance ($TS^2*HER^{1/2}$) of tensile strength and a hole expansion ratio, and a yield ratio evaluation index (1−YR) targeted thereby.

The present invention controls a ratio of the content ($[B]_{TM}$, wt %) of boron (B) contained in the fresh martensite to the content ($[B]_{FM}$, wt %) of boron (B) contained in the tempered martensite to be in a range of 0.03 to 0.55 as shown in relational expression 1, so as to secure a balance ($B_{TE}$) of tensile strength and elongation of $3.0*10^6$ to $6.2*10^6$ ($MPa^2\%^{1/2}$), a balance ($B_{TH}$) of tensile strength and a hole expansion ratio of $6.0*10^6$ to $11.5*10^6$ ($MPa^2\%^{1/2}$), and a yield ratio evaluation index ($I_{YR}$) of 0.15 to 0.42 at the same time.

The inventors of the present invention conducted in-depth research on a method for securing physical properties of a boron(B)-added TRIP steal, and as a result, noted that the physical properties targeted by the present invention may be secured only when a ratio of a content of boron (B) contained in fresh martensite to a content of boron (B) contained in tempered martensite satisfies a certain range, even though the theoretical basis thereof is not clearly identified. In particular, it was able to identify that a yield ratio of a steel sheet has a constant tendency according to a content ratio of boron (B) contained in tempered martensite and fresh martensite. Therefore, the present invention limits the ratio of the content of boron (B) contained in the fresh martensite to the content of boron (B) contained in the tempered martensite to be in a range of 0.03 to 0.55 as shown in relational expression 1, thereby securing a balance ($TS^2*EL^{1/2}$) of tensile strength and elongation, a balance ($TS^2*HER^{1/2}$) of tensile strength and a hole expansion ratio, and a yield ratio evaluation index (1−YR) targeted thereby.

In addition, the inventors of the present invention could know that not only a fraction of retained austenite, a ratio of retained austenite having specific size, shape and type to the entire retained austenite is a factor for securing strength and workability.

As a ratio of retained austenite having an average grain size of 1.2 μm or more to the retained austenite increases, it helps enhancement in workability of a steel sheet. Retained austenite having an average grain size of 1.2 μm or more is retained austenite that is heat-treated at a bainite forming temperature, and has an increased average size, and is a structure in which transformation driving force to martensite is suppressed relative to retained austenite having an average grain size of 1.2 μm or less. Therefore, since transformation from retained austenite having an average grain size of 1.2 μm or more to martensite is suppressed, when a ratio of retained austenite having an average grain size of 1.2 μm or more is greater than a certain level, workability of a steel sheet may be more effectively enhanced.

As a ratio of tempered retained austenite in lath form increases, workability of a steel sheet may be beneficially enhanced. Retained austenite is classified into retained austenite in lath form formed between bainite phases and retained austenite in a form of block formed on a portion having no bainite phase. The retained austenite in a form of block is additionally transformed to fresh martensite during a heat treatment process, and therefore, when a ratio of retained austenite in lath form is greater than a certain level, workability of a steel sheet may be more effectively secured.

As a ratio of tempered retained austenite to the retained austenite increases, workability of a steel sheet may be beneficially enhanced. Tempered retained austenite is retained austenite concentrated with carbon (C) introduced during heat treatment at a bainite forming temperature, and has a content (weight %) of carbon (C) that is at least 1.45 times than an average content (weight %) of carbon (C) of a steel sheet. Tempered retained austenite is relatively concentrated with an austenite stabilizing element, i.e., carbon (C), and therefore, transformation to martensite is suppressed, and when a ratio of tempered retained austenite is greater than a certain level, workability of a steel sheet may be more effectively secured.

Retained austenite having an average grain size of 1.2 μm or more, retained austenite in lath form and tempered retained austenite are those classified from retained austenite on the basis of size, shape and type, respectively, and the concepts thereof can be coexisted.

The present invention controls a ratio of a fraction (V(1.2 μm, γ), vol %) of retained austenite having an average grain size of 1.2 μm or more to a fraction (V(γ), vol %) of the entire retained austenite contained in a steel sheet to be 0.12 or more as in relational expression 2, controls a ratio of a fraction (V(lath, γ), vol %) of retained austenite in lath form to a fraction (V(γ), vol %) of retained austenite contained in a steel sheet to be 0.5 or more as in relational expression 3, and limits a ratio of a fraction (T(γ), vol %) of tempered retained austenite to a fraction (V(γ), vol %) of retained austenite contained in a steel sheet to be 0.08 or more as in relational expression 4, and therefore, may effectively secure a balance ($TS^2*EL^{1/2}$) of tensile strength and elongation, a balance ($TS^2*HER^{1/2}$) of tensile strength and a hole expansion ratio.

In the high strength steel sheet having excellent workability according to an aspect of the present invention, a balance ($B_{TE}$) of tensile strength and elongation expressed by the following relational expression 5 may satisfy $3.0*10^6$ to $6.2*10^6$ ($MPa^2\%^{1/2}$), a balance ($B_{TH}$) of tensile strength and a hole expansion ratio expressed by the following relational expression 6 may satisfy $6.0*10^6$ to $11.5*10^6$ ($MPa^2\%^{1/2}$), and a yield ratio evaluation index ($I_{YR}$) expressed by the following relational expression 7 may satisfy 0.15 to 0.42:

$$B_{TE}=[\text{Tensile Strength } (TS,MPa)]^2*[\text{Elongation } (El,\%)]^{1/2h}; \quad \text{[Relational Expression 5]}$$

$$B_{TH}=[\text{Tensile Strength } (TS,MPa)]^2*[\text{Hole Expansion Ratio } (HER,\%)]^{1/2}; \text{ and} \quad \text{[Relational Expression 6]}$$

$$I_{YR}=1-[\text{Yield Ratio } (YR)]. \quad \text{[Relational Expression 7]}$$

Hereinafter, an example of a method for manufacturing a steel sheet of the present invention will be described in detail.

A method for manufacturing a high strength steel sheet having excellent workability according to an aspect of the present invention may comprises: heating (primarily heating) a cold-rolled steel sheet having a predetermined alloy composition to a temperature of 700° C. at an average heating rate of 5° C./s or more, heating (secondarily heating) the primarily heated steel sheet to a temperature within a range of Ac3 to 920° C. at an average heating rate of 5° C./s or less, and then maintaining (primarily maintaining) the secondarily heated steel sheet for 50 to 1200 seconds; cooling (primarily cooling) the primarily maintained steel sheet to a temperature within a range of 400 to 600° C. at an average cooling rate of 2 to 100° C./s, and then maintaining (secondarily maintaining) the primarily cooled steel sheet for 5 to 600 seconds; cooling (secondarily cooling) the secondarily maintained steel sheet to a temperature within a range of 300 to 500° C. at an average cooling rate of 1 to 100° C./s, and then maintaining (tertiarily maintaining) the secondarily cooled steel sheet for 5 to 600 seconds; cooling (tertiarily cooling) the tertiarily maintained steel sheet to a temperature within a range of 200 to 400° C. at an average cooling rate of 2 to 100° C./s; heating (tertiarily heating) the tertiarily cooled steel sheet to a temperature within a range of 400 to 600° C. at an average heating rate of 5 to 100° C./s, and then maintaining (quaternarily maintaining) the tertiarily heated steel sheet for 10 to 1800 seconds; cooling (quaternarily cooling) the quaternarily maintained steel sheet to a temperature within a range of 300 to 500° C. at an average cooling rate of 1 to 100° C./s, and then maintaining (quintically maintaining) the quaternarily cooled steel sheet for 10 to 1800 seconds; and cooling (quintically cooling) the quintically maintained steel sheet to room temperature at an average cooling rate of 1° C./s or more.

The cold-rolled steel sheet may be provided by: heating steel slab having a predetermined alloy composition to 1000 to 1350° C.; performing finishing hot rolling at a temperature within a range of 800 to 1000° C.; coiling the hot-rolled steel sheet at a temperature within a range of 350 to 600° C.; pickling the coiled steel sheet; and cold rolling the pickled steel sheet at a reduction ratio of 30 to 90%.

Preparation and Heating of Steel Slab

A steel slab having a predetermined alloy composition is prepared. Since the steel slab according to the present invention includes an alloy composition corresponding to an alloy composition of the steel sheet described above, the description of the alloy compositions of the slab is replaced by the description of the alloy composition of the steel sheet described above.

The prepared steel slab may be heated to a temperature within a certain range, and the heating temperature of the steel slab at this time may be in the range of 1000 to 1350° C. When the heating temperature of the steel slab is less than 1000° C., the steel slab may be hot rolled at a temperature within a range below a desired finish hot rolling temperature range, and when the heating temperature of the steel slab exceeds 1350° C., the temperature reaches a melting point of steel, and thus, the steel slab may be melted.

Hot Rolling and Coiling

The heated steel slab may be hot rolled, and thus, provided as a hot-rolled steel sheet. During the hot rolling, the finish hot rolling temperature is preferably in the range of 800 to 1000° C. When the finish hot rolling temperature is lower than 800° C., an excessive rolling load may be a problem, and when the finish hot rolling temperature exceeds 1000° C., grains of the hot-rolled steel sheet are coarsely formed, which may cause a deterioration in physical properties of the final steel sheet.

After the hot rolling has been completed, the hot-rolled steel sheet may be cooled at an average cooling rate of 10° C./s or more, and may be coiled at a temperature within a range of 350 to 650° C. When the coiling temperature is lower than 350° C., coiling is not easy, and when the coiling temperature exceeds 650° C., surface scale may be formed into the inside of the hot-rolled steel sheet, which may make pickling difficult.

Pickling and Cold Rolling

After uncoiling the coiled hot-rolled coil, in order to remove the scale generated on the surface of the steel sheet, the pickling may be performed, and the cold rolling may be performed. Although the conditions of the pickling and the cold rolling are not particularly limited in the present invention, the cold rolling is preferably performed at a cumulative reduction ratio of 30 to 90%. When the cumulative reduction ratio of the cold rolling exceeds 90%, it may be difficult to perform the cold rolling in a short time due to the high strength of the steel sheet.

The cold-rolled steel sheet may be manufactured as a non-plated cold-rolled steel sheet through the annealing heat treatment process, or may be manufactured as a plated steel sheet through a plating process to impart corrosion resistance. As the plating, plating methods such as hot-dip galvanizing, electro-galvanizing, and hot-dip aluminum plating may be applied, and the method and the type are not particularly limited.

Annealing Heat Treatment

In the present invention, in order to simultaneously secure the strength and workability of the steel sheet, the annealing heat treatment process is performed.

The cold-rolled steel sheet is heated (primarily heating) to a temperature of 700° C. at an average heating rate of 5° C./s or more, is heated (secondarily heated) to a temperature within a range of Ac3 to 920° C. at an average heating rate of 5° C./s or less, and then is maintained (primarily maintaining) for 50 to 1200 seconds.

When the average heating rate to a temperature of 700° C. of the primary heating is less than 5° C./s, lump austenite is formed from ferrite and cementite generated during heating, and as a result, fine tempered martensite and retained austenite cannot be formed as a final structure. Therefore, a targeted T(γ)/V(γ), a targeted balance ($TS^2*EL^{1/2}$) of tensile strength and elongation, and a targeted balance ($TS^2*HER^{1/2}$) of tensile strength and a hole expansion ratio cannot be implemented. In addition, when the secondary heating rate up to the primary maintaining temperature exceeds 5° C./s, transformation from cementite generated during heating to austenite is accelerated, so that a large amount of lump austenite is formed, the final structure is coarsened, and boron (B) may not be sufficiently concentrated into tempered martensite. As a result, $[B]_{FM}/[B]_{TM}$ exceeds 0.55, and targeted levels of a balance ($TS^2*EL^{1/2}$) of tensile strength and elongation and a balance ($TS^2*HER^{1/2}$) of tensile strength and a hole expansion ratio, and a yield ratio evaluation index ($I_{YR}$) cannot be implemented.

When the primary maintaining temperature is lower than Ac3 (two-phase region), 5 vol % or more of ferrite is formed, and therefore, a balance ($TS^2*EL^{1/2}$) of tensile strength and elongation and a balance ($TS^2*HER^{1/2}$) of tensile strength and a hole expansion ratio may be lowered. In addition, when the primary maintaining time is less than 50 seconds, the structure may not be sufficiently homogenized and the physical properties of the steel sheet may be lowered. Upper limits of the primary maintaining temperature and the primary maintaining time are not particularly limited, but it is preferable that the primary maintaining temperature is limited to 920° C. or less, and the primary maintaining time is limited to 1200 seconds or less, in order to prevent toughness reduction due to coarsened grains.

After the primary maintaining, the primarily maintained steel sheet may be cooled (primarily cooled) to a temperature within a range of 400 to 600° C. at a primary cooling rate with an average cooling rate of 2° C. or more, and then may be maintained (secondarily maintained) for 5 seconds or more. When the average cooling rate of the primary cooling is less than 2° C./s, a fraction of retained austenite becomes insufficient due to a slow cooling, and therefore, T(γ)/V(γ), a balance ($TS^2*EL^{1/2}$) of tensile strength and elongation, and a balance ($TS^2*HER^{1/2}$) of tensile strength and a hole expansion ratio of the steel sheet may be lowered.

An upper limit of the average cooling rate of the primary cooling does not need to be particularly specified, but is preferably set to be 100° C./s or less. When the secondary maintaining temperature is less than 400° C., V(1.2 μm, γ), and a balance ($TS^2*HER^{1/2}$) of tensile strength and a hole expansion ratio of the steel sheet may be lowered, due to a low heat treatment temperature. On the other hand, when the secondary maintaining temperature is more than 600° C., a fraction of retained austenite becomes insufficient, whereby T(γ)/V(γ), V(lath, γ)/V(γ), a balance ($TS^2*EL^{1/2}$) of tensile strength and elongation, and a balance ($TS^2*HER^{1/2}$) of tensile strength and a hole expansion ratio of the steel sheet may be lowered. In addition, when the secondary maintaining time is less than 5 seconds, a heat treatment time becomes insufficient, whereby V(lath, γ)/V(γ), V(1.2 μm, γ)/V(γ), and a balance ($TS^2*HER^{1/2}$) of tensile strength and a hole expansion ratio of the steel sheet may be lowered. An upper limit of the secondary maintaining time does not need to be particularly specified, but is preferably set to be 600 seconds or less.

After the secondary maintaining, the secondarily maintained steel sheet may be cooled (secondarily cooled) to a temperature within a range of 300 to 500° C. at an average cooling rate of 1° C. or more, and then may be maintained (tertiarily maintaining) for 5 seconds or more. An upper limit of the average cooling rate of the secondary cooling does not need to be particularly specified, but is preferably set to be 100° C./s or less. When the tertiary maintaining temperature is less than 300° C., V(1.2 μm, γ)/V(γ), and a balance ($TS^2*HER^{1/2}$) of tensile strength and a hole expansion ratio of the steel sheet may be lowered, due to a low heat treatment temperature. On the other hand, when the tertiary maintaining temperature is greater than 500° C./s, a fraction of retained austenite becomes insufficient, whereby T(γ)/V(γ), V(lath, γ)/V(γ), a balance ($TS^2*EL^{1/2}$) of tensile strength and elongation, and a balance ($TS^2*HER^{1/2}$) of tensile strength and a hole expansion ratio of the steel sheet may be lowered. In addition, when the tertiary maintaining time is less than 5 seconds, a heat treatment time becomes insufficient, whereby V(lath, γ)/V(γ), V(1.2 μm, γ)/V(γ), and a balance ($TS^2*HER^{1/2}$) of tensile strength and a hole expansion ratio of the steel sheet may be lowered. An upper limit of the tertiary maintaining time does not need to be particularly specified, but is preferably set to be 600 seconds or less.

After the tertiary maintaining, the tertiarily maintained steel sheet may be cooled (tertiarily cooled) to a primary cooling stop temperature of 200 to 400° C. at an average cooling rate of 2° C. or more. When the average cooling rate of the tertiary cooling is less than 2° C./s, a fraction of retained austenite becomes insufficient due to a slow cooling, and therefore, T(γ)/V(γ), a balance ($TS^2*EL^{1/2}$) of tensile strength and elongation, and a balance ($TS^2*HER^{1/2}$) of tensile strength and a hole expansion ratio may be lowered. An upper limit of the average cooling rate of the tertiary cooling does not need to be particularly specified, but is preferably set to be 100° C./s or less. When the primary cooling stop temperature is less than 200° C., tempered martensite is excessively formed, and retained austenite becomes insufficient, whereby T(γ)/V(γ), V(1.2 μm, γ)/V(γ), a balance ($TS^2*EL^{1/2}$) of tensile strength and elongation, and a balance ($TS^2*HER^{1/2}$) of tensile strength and a hole expansion ratio of the steel sheet may be lowered. On the other hand, when the primary cooling stop temperature is more than 400° C., bainite is excessively formed, and tempered martensite becomes insufficient, whereby a balance ($TS^2*EL^{1/2}$) of tensile strength and elongation and a balance ($TS^2*HER^{1/2}$) of tensile strength and a hole expansion ratio of the steel sheet may be lowered.

After the tertiary cooling, the tertiarily cooled steel sheet may be heated (tertiarily heated) to a temperature within a range of 400 to 600° C. at an average heating rate of 5° C./s or more, and then the tertiary heated steel sheet may be maintained (quaternarily maintained) for 10 to 1800 seconds. An upper limit of the average heating rate of the tertiary heating does not need to be particularly specified, but is preferably set to be 100° C./s or less. When the quaternary maintaining temperature is less than 400° C., V(1.2 μm, γ)/V(γ), and a balance ($TS^2*HER^{1/2}$) of tensile strength and a hole expansion ratio of the steel sheet may be lowered, due to a low heat treatment temperature. When the quaternary maintaining temperature is more than 600° C., a fraction of retained austenite becomes insufficient, whereby T(γ)/V(γ), V(1.2 μm, γ)/V(γ), a balance ($TS^2*EL^{1/2}$) of tensile strength and elongation, and a balance ($TS^2*HER^{1/2}$) of tensile strength and a hole expansion ratio may be lowered. When the quaternary maintaining time is less than 10 seconds, a heat treatment time becomes insufficient, whereby V(1.2 μm, γ)/V(γ), a balance ($TS^2*HER^{1/2}$) of tensile strength and a hole expansion ratio of the steel sheet may be lowered. An upper limit of the quaternary maintaining time does not need to be particularly specified, but is preferably set to be 1800 seconds or less.

After the quaternary maintaining, the quaternarily maintained steel sheet may be cooled (quaternarily cooled) to a temperature within a range of 300 to 500° C. at an average cooling rate of 1° C./s or more, and then the quaternarily cooled steel sheet may be maintained (quintically maintained) for 10 to 1800 seconds. An upper limit of the average cooling rate of the quaternary cooling does not need to be particularly specified, but is preferably set to be 100° C./s or less. When the quintic maintaining temperature is less than 300° C., V(1.2 μm, γ)/V(γ), and a balance ($TS^2*HER^{1/2}$) of tensile strength and a hole expansion ratio may be lowered, due to a low heat treatment temperature. On the other hand, when the quintically maintaining temperature is more than 500° C., retained austenite becomes insufficient, whereby T(γ)/V(γ), V(1.2 μm, γ)/V(γ), a balance ($TS^2*EL^{1/2}$) of tensile strength and elongation, and a balance ($TS^2*HER^{1/2}$) of tensile strength and a hole expansion ratio of the steel sheet may be lowered. When quintic maintaining time is less than 10 seconds, a heat treatment time becomes insufficient, whereby V(1.2 μm, γ)/V(γ), and a balance ($TS^2*HER^{1/2}$) of tensile strength and a hole expansion ratio of the steel sheet may be lowered. An upper limit of the quintic maintaining time does not need to be particularly specified, but is preferably set to be 1800 seconds or less.

The cooling rate (Vc1) of the primary cooling and the cooling rate (Vc4) of the quaternary cooling may satisfy a relation of Vc1>Vc4.

After the quintic maintaining, the quintically maintained steel sheet may be cooled (quintically cooled) to room temperature at an average cooling rate of 1° C./s or more.

The high strength steel sheet having excellent workability manufactured by the aforementioned manufacturing method may comprise, as microstructures, bainite, tempered martensite, fresh martensite, retained austenite and unavoidable structures, and as a preferable example, may comprise, by volume fraction, 10 to 30% of bainite, 50 to 70% of tempered martensite, 10 to 30% of fresh martensite, 2 to 10% of retained austenite, and 5% or less (including 0%) of ferrite.

In the high strength steel sheet having excellent workability manufactured by the aforementioned manufacturing method, a balance ($B_{TE}$) of tensile strength and elongation expressed by the following relational expression 5 may satisfy $3.0*10^6$ to $6.2*10^6$ ($MPa^2\%^{1/2}$), a balance ($B_{TH}$) of tensile strength and a hole expansion ratio expressed by the following relational expression 6 may satisfy $6.0*10^6$ to $11.5*10^6$ ($MPa^2\%^{1/2}$), and a yield ratio evaluation index ($I_{YR}$) expressed by the following relational expression 7 may satisfy 0.15 to 0.42:

$$B_{TE}=[\text{Tensile Strength } (TS,MPa)]^2*[\text{Elongation } (El,\%)]^{1/2}; \quad \text{[Relational Expression 5]}$$

$$B_{TH}=[\text{Tensile Strength } (TS,MPa)]^2*[\text{Hole Expansion Ratio } (HER,\%)]^{1/2}; \text{ and} \quad \text{[Relational Expression 6]}$$

$$I_{YR}=1-[\text{Yield Ratio } (YR)]. \quad \text{[Relational Expression 7]}$$

MODE FOR INVENTION

Hereinafter, a high strength steel sheet having excellent workability and a method for manufacturing same according to an aspect of the present invention will be described in more detail. It should be noted that the following examples are only for the understanding of the present invention, and are not intended to specify the scope of the present invention. The scope of the present invention is determined by matters described in claims and matters reasonably inferred therefrom.

INVENTIVE EXAMPLES

A steel slab having a thickness of 100 mm having alloy compositions (a balance of Fe and unavoidable impurities)

shown in Table 1 below was prepared, heated at 1200° C., and then subjected to finish hot rolling at 900° C. Thereafter, the steel slab was cooled at an average cooling rate of 30° C./s, and coiled at a coiling temperature of Tables 2 and 3 to manufacture a hot-rolled steel sheet having a thickness of 3 mm. Thereafter, after removing a surface scale by pickling, cold rolling was performed to a thickness of 1.5 mm.

Thereafter, the heat treatment was performed under the annealing heat treatment conditions shown in Tables 2 to 7 to manufacture the steel sheet. In Tables 2 and 3, the single-phase region means a temperature range of Ac3 to 920° C., and the two-phase region means a temperature range below Ac3° C.

The microstructure of the thus prepared steel sheet was observed, and the results were shown in Tables 8 and 9. Among the microstructures, ferrite (F), bainite (B), tempered martensite (TM), fresh martensite (FM) and pearlite (P) were observed through SEM after nital-etching a polished specimen cross section. After nital-etching, a structure having no concave-convex portions on a surface of a specimen was classified as ferrite, and a structure having a lamella structure of cementite and ferrite is classified as pearlite. Since both of bainite (B) and tempered martensite (TM) were observed in lath form and block, and were difficult to distinguish each other, the fractions of bainite and tempered martensite were calculated using an expansion curve after evaluating dilatation. That is, a value obtained by subtracting the fraction of tempered martensite calculated using the expansion curve from the fraction of bainite and tempered martensite measured by the SEM observation was determined as the fraction of bainite. Meanwhile, since fresh martensite (FM) and retained austenite (retained γ) are also difficult to distinguish each other, a value obtained by subtracting the fraction of retained austenite calculated by an X-ray diffraction method from the fraction of martensite and retained austenite observed by the SEM was determined as the fraction of the fresh martensite.

Meanwhile, [B]/[B]m, V(1.2 μm, γ)/V(γ), V(lath, γ)/V(γ), T(γ)/V(γ), a balance ($TS^2*EL^{1/2}$) of tensile strength and elongation, a balance ($TS^2*HER^{1/2}$) of tensile strength and a hole expansion ratio, and a yield ratio evaluation index ($I_{YR}$) of the steel sheet were measured and evaluated, and the results thereof were shown in Tables 10 and 11.

The concentrations of boron (B) in fresh martensite and tempered martensite measured using an electron probe microanalyser (EPMA) were determined as a content ($[B]_{FM}$) of boron (B) contained in fresh martensite, and a content ($[B]_{TM}$) of boron (B) contained in tempered martensite. A fraction (V(1.2 μm, γ)) of retained austenite having an average grain size of 1.2 μm or more was measured by using a phase map of an electron backscatter diffraction (EBSD). Tempered retained austenite was classified based on a content of carbon (C) measured in retained austenite by using an EPMA.

Tensile strength (TS) and elongation (El) were evaluated through a tensile test, and the tensile strength (TS) and the elongation (El) were measured by evaluating the specimens collected in accordance with JIS No. 5 standard based on a 90° direction with respect to a rolling direction of a rolled sheet. The hole expansion ratio (HER) was evaluated through a hole expansion test, and was calculated by the following relational expression 8, after forming a punching hole (die inner diameter of 10.3 mm, clearance of 12.5%) of 10 mmW, inserting a conical punch having an apex angle of 60° into a punching hole in a direction in which a burr of the punching hole faces outward, and then compressing and expanding a peripheral portion of the punching hole at a moving speed of 20 mm/min:

$$\text{Hole Expansion Ratio } (HER,\%) = \{(D-D_0)/D_0\}\times 100 \quad \text{[Relational Expression 8]}$$

In the above relational expression 8, D is a hole diameter (mm) when cracks penetrate through the steel sheet along the thickness direction, and Do is the initial hole diameter (mm).

TABLE 1

| Steel | Chemical Components (wt %) | | | | | | | | | | |
|---|---|---|---|---|---|---|---|---|---|---|---|
| Type | C | Si | Mn | P | S | Al | N | Cr | Mo | B | Others |
| A | 0.14 | 0.53 | 2.35 | 0.011 | 0.0009 | 0.42 | 0.0029 | | | 0.0024 | |
| B | 0.15 | 0.49 | 2.26 | 0.009 | 0.0011 | 0.51 | 0.0027 | 0.27 | 0.39 | 0.0028 | |
| C | 0.17 | 0.60 | 2.44 | 0.008 | 0.0010 | 0.46 | 0.0030 | | 0.59 | 0.0021 | |
| D | 0.19 | 0.57 | 1.69 | 0.010 | 0.0007 | 0.92 | 0.0031 | 0.85 | | 0.0032 | |
| E | 0.20 | 1.46 | 2.58 | 0.007 | 0.0012 | 0.08 | 0.0028 | | | 0.0047 | |
| F | 0.21 | 0.18 | 1.92 | 0.012 | 0.0010 | 1.45 | 0.0025 | | | 0.0043 | |
| G | 0.17 | 0.35 | 2.27 | 0.009 | 0.0008 | 0.79 | 0.0026 | | | 0.0027 | Ti: 0.05 |
| H | 0.18 | 0.42 | 2.49 | 0.011 | 0.0007 | 0.38 | 0.0032 | | | 0.0025 | Nb: 0.05 |
| I | 0.13 | 0.47 | 2.30 | 0.008 | 0.0011 | 0.46 | 0.0030 | | | 0.0022 | V: 0.05 |
| J | 0.16 | 0.28 | 1.82 | 0.009 | 0.0008 | 0.47 | 0.0027 | | | 0.0018 | Ni: 0.34 |
| K | 0.12 | 0.52 | 2.23 | 0.007 | 0.0012 | 0.53 | 0.0029 | | | 0.0014 | Cu: 0.36 |
| L | 0.23 | 0.79 | 2.45 | 0.012 | 0.0009 | 0.62 | 0.0026 | | | 0.0009 | |
| M | 0.16 | 0.45 | 3.81 | 0.010 | 0.0010 | 0.59 | 0.0025 | | | 0.0008 | Ca: 0.003 |
| N | 0.21 | 0.91 | 2.56 | 0.007 | 0.0007 | 0.55 | 0.0032 | | | 0.0036 | REM: 0.002 |
| O | 0.18 | 0.64 | 2.48 | 0.011 | 0.0011 | 0.49 | 0.0031 | | | 0.0030 | Mg: 0.003 |
| P | 0.15 | 0.56 | 2.39 | 0.008 | 0.0009 | 0.53 | 0.0028 | | | 0.0034 | W: 0.16 |
| Q | 0.19 | 0.65 | 2.71 | 0.007 | 0.0012 | 0.49 | 0.0029 | | | 0.0038 | Zr: 0.15 |
| R | 0.16 | 0.04 | 2.62 | 0.012 | 0.0008 | 1.47 | 0.0033 | | | 0.0026 | Sb: 0.03 |
| S | 0.15 | 1.45 | 2.45 | 0.008 | 0.0011 | 0.05 | 0.0031 | | | 0.0027 | Sn: 0.03 |
| T | 0.20 | 0.94 | 2.50 | 0.011 | 0.0008 | 0.63 | 0.0028 | | | 0.0025 | Y: 0.02 |
| U | 0.18 | 0.66 | 2.46 | 0.010 | 0.0009 | 0.58 | 0.0029 | | | 0.0024 | Hf: 0.03 |
| V | 0.16 | 0.78 | 2.62 | 0.009 | 0.0010 | 0.49 | 0.0026 | | | 0.0020 | Co: 0.36 |
| XA | 0.07 | 0.53 | 2.51 | 0.010 | 0.0007 | 0.54 | 0.0030 | | | 0.0023 | |
| XB | 0.27 | 0.65 | 2.64 | 0.007 | 0.0011 | 0.61 | 0.0030 | | | 0.0028 | |
| XC | 0.15 | 0.006 | 2.88 | 0.011 | 0.0012 | 0.005 | 0.0028 | | | 0.0032 | |
| XD | 0.17 | 1.54 | 2.52 | 0.010 | 0.0008 | 0.59 | 0.0025 | | | 0.0035 | |
| XE | 0.18 | 0.53 | 2.45 | 0.007 | 0.0011 | 1.56 | 0.0029 | | | 0.0037 | |
| XF | 0.14 | 0.47 | 0.94 | 0.008 | 0.0007 | 0.54 | 0.0026 | | | 0.0028 | |

TABLE 1-continued

| Steel | Chemical Components (wt %) | | | | | | | | | | |
|---|---|---|---|---|---|---|---|---|---|---|---|
| Type | C | Si | Mn | P | S | Al | N | Cr | Mo | B | Others |
| XG | 0.18 | 0.55 | 4.11 | 0.010 | 0.0009 | 0.72 | 0.0031 | | | 0.0025 | |
| XH | 0.16 | 0.58 | 2.47 | 0.009 | 0.0012 | 0.53 | 0.0032 | 3.26 | | 0.0029 | |
| XI | 0.15 | 0.49 | 2.53 | 0.011 | 0.0008 | 0.49 | 0.0027 | | 3.18 | 0.0024 | |
| XJ | 0.17 | 0.43 | 2.56 | 0.008 | 0.0011 | 0.45 | 0.0029 | | | 0.0003 | |
| XK | 0.14 | 0.51 | 2.45 | 0.012 | 0.012 | 0.42 | 0.0031 | | | 0.0053 | |

TABLE 2

| Specimen No. | Steel Type | Coiling Temp. of Hot-rolled Steel Sheet (° C.) | Primary Average Heating Rate (° C./s) | Primary Heating Stop Temp. (° C.) | Secondary Average Heating Rate (° C./s) | Primary Maintaining Temp. Region | Primary Maintaining Time (s) |
|---|---|---|---|---|---|---|---|
| 1 | DI | 550 | 15 | 700 | 0.5 | Single-phase Region | 180 |
| 2 | A | 550 | 1 | 700 | 0.5 | Single-phase Region | 180 |
| 3 | A | 550 | 15 | 700 | 10 | Single-phase Region | 180 |
| 4 | A | 550 | 15 | 700 | 0.5 | Two-phase Region | 180 |
| 5 | A | 550 | 15 | 700 | 0.5 | Single-phase Region | 180 |
| 6 | A | 550 | 15 | 700 | 0.5 | Single-phase Region | 180 |
| 7 | A | 550 | 15 | 700 | 0.5 | Single-phase Region | 180 |
| 8 | A | 550 | 15 | 700 | 0.5 | Single-phase Region | 180 |
| 9 | A | 550 | 15 | 700 | 0.5 | Single-phase Region | 180 |
| 10 | A | 550 | 15 | 700 | 0.5 | Single-phase Region | 180 |
| 11 | A | 550 | 15 | 700 | 0.5 | Single-phase Region | 180 |
| 12 | A | 550 | 15 | 700 | 0.5 | Single-phase Region | 180 |
| 13 | A | 550 | 15 | 700 | 0.5 | Single-phase Region | 180 |
| 14 | A | 550 | 15 | 700 | 0.5 | Single-phase Region | 180 |
| 15 | A | 550 | 15 | 700 | 0.5 | Single-phase Region | 180 |
| 16 | A | 550 | 15 | 700 | 0.5 | Single-phase Region | 180 |
| 17 | A | 550 | 15 | 700 | 0.5 | Single-phase Region | 180 |
| 18 | A | 550 | 15 | 700 | 0.5 | Single-phase Region | 180 |
| 19 | A | 550 | 15 | 700 | 0.5 | Single-phase Region | 180 |

TABLE 2-continued

| Specimen No. | Steel Type | Coiling Temp. of Hot-rolled Steel Sheet (° C.) | Primary Average Heating Rate (° C./s) | Primary Heating Stop Temp. (° C.) | Secondary Average Heating Rate (° C./s) | Primary Maintaining Temp. Region | Primary Maintaining Time (s) |
|---|---|---|---|---|---|---|---|
| 20 | A | 550 | 15 | 700 | 0.5 | Single-phase Region | 180 |
| 21 | B | 500 | 15 | 700 | 0.5 | Single-phase Region | 180 |
| 22 | C | 500 | 15 | 700 | 0.5 | Single-phase Region | 180 |
| 23 | D | 500 | 15 | 700 | 0.5 | Single-phase Region | 180 |
| 24 | E | 450 | 15 | 700 | 0.5 | Single-phase Region | 180 |
| 25 | F | 450 | 15 | 700 | 0.5 | Single-phase Region | 180 |
| 26 | G | 450 | 15 | 700 | 0.5 | Single-phase Region | 180 |
| 27 | H | 500 | 15 | 700 | 0.5 | Single-phase Region | 180 |
| 28 | I | 550 | 15 | 700 | 0.5 | Single-phase Region | 180 |
| 29 | J | 400 | 15 | 700 | 0.5 | Single-phase Region | 180 |
| 30 | K | 600 | 15 | 700 | 0.5 | Single-phase Region | 180 |

TABLE 3

| Specimen No. | Steel Type | Coiling Temp. of Hot-rolled Steel Sheet (° C.) | Primary Average Heating Rate (° C./s) | Primary Heating Stop Temp. (° C.) | Secondary Average Heating Rate (° C./s) | Primary Maintaining Temp. Region | Primary Maintaining Time (s) |
|---|---|---|---|---|---|---|---|
| 31 | L | 550 | 15 | 700 | 0.5 | Single-phase Region | 180 |
| 32 | M | 550 | 15 | 700 | 0.5 | Single-phase Region | 180 |
| 33 | N | 600 | 15 | 700 | 0.5 | Single-phase Region | 180 |
| 34 | O | 550 | 15 | 700 | 0.5 | Single-phase Region | 180 |
| 35 | P | 450 | 15 | 700 | 0.5 | Single-phase Region | 180 |
| 36 | Q | 550 | 15 | 700 | 0.5 | Single-phase Region | 180 |
| 37 | R | 400 | 15 | 700 | 0.5 | Single-phase Region | 180 |
| 38 | S | 500 | 15 | 700 | 0.5 | Single-phase Region | 180 |

TABLE 3-continued

| Specimen No. | Steel Type | Coiling Temp. of Hot-rolled Steel Sheet (° C.) | Primary Average Heating Rate (° C./s) | Primary Heating Stop Temp. (° C.) | Secondary Average Heating Rate (° C./s) | Primary Maintaining Temp. Region | Primary Maintaining Time (s) |
|---|---|---|---|---|---|---|---|
| 39 | T | 500 | 15 | 700 | 0.5 | Single-phase Region | 180 |
| 40 | U | 500 | 15 | 700 | 0.5 | Single-phase Region | 180 |
| 41 | V | 500 | 15 | 700 | 0.5 | Single-phase Region | 180 |
| 42 | XA | 550 | 15 | 700 | 0.5 | Single-phase Region | 180 |
| 43 | XB | 550 | 15 | 700 | 0.5 | Single-phase Region | 180 |
| 44 | XC | 550 | 15 | 700 | 0.5 | Single-phase Region | 180 |
| 45 | XD | 550 | 15 | 700 | 0.5 | Single-phase Region | 180 |
| 46 | XE | 550 | 15 | 700 | 0.5 | Single-phase Region | 180 |
| 47 | XF | 500 | 15 | 700 | 0.5 | Single-phase Region | 180 |
| 48 | XG | 500 | 15 | 700 | 0.5 | Single-phase Region | 180 |
| 49 | XH | 500 | 15 | 700 | 0.5 | Single-phase Region | 180 |
| 50 | XI | 500 | 15 | 700 | 0.5 | Single-phase Region | 180 |
| 51 | XJ | 500 | 15 | 700 | 0.5 | Single-phase Region | 180 |
| 52 | XK | 500 | 15 | 700 | 0.5 | Single-phase Region | 180 |

TABLE 4

| Specimen No. | Steel Type | Primary Average Cooling Rate (° C./s) | Secondary Maintaining Temp. (° C.) | Secondary Maintaining Time (s) | Secondary Average Cooing Rate (° C./s) | Tertiary Maintaining Temp. (° C.) | Tertiary Maintaining Time (s) | Tertiary Average Cooing Rate (° C./s) | Primary Cooling Stop Temp. (° C.) |
|---|---|---|---|---|---|---|---|---|---|
| 1 | A | 20 | 500 | 40 | 10 | 400 | 40 | 20 | 300 |
| 2 | A | 20 | 500 | 40 | 10 | 400 | 40 | 20 | 300 |
| 3 | A | 20 | 500 | 40 | 10 | 400 | 40 | 20 | 300 |
| 4 | A | 20 | 500 | 40 | 10 | 400 | 40 | 20 | 300 |
| 5 | A | 0.5 | 500 | 40 | 10 | 400 | 40 | 20 | 300 |
| 6 | A | 20 | 380 | 40 | 10 | 350 | 40 | 20 | 300 |
| 7 | A | 20 | 630 | 40 | 10 | 400 | 40 | 20 | 350 |
| 8 | A | 20 | 500 | 2 | 10 | 400 | 40 | 20 | 300 |
| 9 | A | 20 | 500 | 40 | 10 | 280 | 40 | 20 | 250 |
| 10 | A | 20 | 550 | 40 | 10 | 520 | 40 | 20 | 300 |
| 11 | A | 20 | 500 | 40 | 10 | 400 | 2 | 20 | 300 |
| 12 | A | 20 | 500 | 40 | 10 | 400 | 40 | 0.5 | 300 |
| 13 | A | 20 | 500 | 40 | 10 | 400 | 40 | 20 | 170 |
| 14 | A | 20 | 500 | 40 | 10 | 450 | 40 | 20 | 420 |
| 15 | A | 20 | 500 | 40 | 10 | 400 | 40 | 20 | 300 |
| 16 | A | 20 | 550 | 40 | 10 | 450 | 40 | 20 | 300 |
| 17 | A | 20 | 550 | 40 | 10 | 450 | 40 | 20 | 300 |
| 18 | A | 20 | 500 | 40 | 10 | 400 | 40 | 20 | 300 |

TABLE 4-continued

| Specimen No. | Steel Type | Primary Average Cooling Rate (° C./s) | Secondary Maintaining Temp. (° C.) | Secondary Maintaining Time (s) | Secondary Average Cooing Rate (° C./s) | Tertiary Maintaining Temp. (° C.) | Tertiary Maintaining Time (s) | Tertiary Average Cooing Rate (° C./s) | Primary Cooling Stop Temp. (° C.) |
|---|---|---|---|---|---|---|---|---|---|
| 19 | A | 20 | 500 | 40 | 10 | 400 | 40 | 20 | 300 |
| 20 | A | 20 | 500 | 40 | 10 | 400 | 40 | 20 | 300 |
| 21 | B | 20 | 500 | 40 | 10 | 400 | 40 | 20 | 300 |
| 22 | C | 20 | 500 | 40 | 10 | 400 | 40 | 20 | 300 |
| 23 | D | 20 | 500 | 40 | 10 | 400 | 40 | 20 | 300 |
| 24 | E | 20 | 500 | 40 | 10 | 450 | 40 | 20 | 350 |
| 25 | F | 20 | 550 | 40 | 10 | 400 | 40 | 20 | 350 |
| 26 | G | 20 | 550 | 40 | 10 | 450 | 40 | 20 | 300 |
| 27 | H | 20 | 500 | 40 | 10 | 350 | 40 | 20 | 300 |
| 28 | I | 20 | 450 | 40 | 10 | 350 | 40 | 20 | 250 |
| 29 | J | 20 | 450 | 40 | 10 | 400 | 40 | 20 | 250 |
| 30 | K | 20 | 500 | 40 | 10 | 400 | 40 | 20 | 300 |

TABLE 5

| Specimen No. | Steel Type | Primary Average Cooling Rate (° C./s) | Secondary Maintaining Temp. (° C.) | Secondary Maintaining Time (s) | Secondary Average Cooing Rate (° C./s) | Tertiary Maintaining Temp. (° C.) | Tertiary Maintaining Time (s) | Tertiary Average Cooing Rate (° C./s) | Primary Cooling Stop Temp. (° C.) |
|---|---|---|---|---|---|---|---|---|---|
| 31 | L | 20 | 500 | 40 | 10 | 400 | 40 | 20 | 300 |
| 32 | M | 20 | 500 | 40 | 10 | 400 | 40 | 20 | 300 |
| 33 | Z | 20 | 500 | 40 | 10 | 450 | 40 | 20 | 300 |
| 34 | O | 20 | 550 | 40 | 10 | 450 | 40 | 20 | 300 |
| 35 | P | 20 | 550 | 40 | 10 | 400 | 40 | 20 | 350 |
| 36 | Q | 20 | 500 | 40 | 10 | 400 | 40 | 20 | 350 |
| 37 | R | 20 | 500 | 40 | 10 | 350 | 40 | 20 | 300 |
| 38 | S | 20 | 450 | 40 | 10 | 350 | 40 | 20 | 300 |
| 39 | T | 20 | 450 | 40 | 10 | 400 | 40 | 20 | 250 |
| 40 | U | 20 | 500 | 40 | 10 | 400 | 40 | 20 | 250 |
| 41 | V | 20 | 500 | 40 | 10 | 400 | 40 | 20 | 300 |
| 42 | XA | 20 | 500 | 40 | 10 | 400 | 40 | 20 | 300 |
| 43 | XB | 20 | 500 | 40 | 10 | 400 | 40 | 20 | 300 |
| 44 | XC | 20 | 550 | 40 | 10 | 450 | 40 | 20 | 300 |
| 45 | XD | 20 | 550 | 40 | 10 | 450 | 40 | 20 | 300 |
| 46 | XE | 20 | 500 | 40 | 10 | 400 | 40 | 20 | 300 |
| 47 | XF | 20 | 500 | 40 | 10 | 400 | 40 | 20 | 350 |
| 48 | XG | 20 | 500 | 40 | 10 | 400 | 40 | 20 | 300 |
| 49 | XH | 20 | 500 | 40 | 10 | 400 | 40 | 20 | 350 |
| 50 | XI | 20 | 500 | 40 | 10 | 400 | 40 | 20 | 300 |
| 51 | XJ | 20 | 500 | 40 | 10 | 400 | 40 | 20 | 300 |
| 52 | XK | 20 | 500 | 40 | 10 | 400 | 40 | 20 | 300 |

TABLE 6

| Specimen No. | Steel Type | Tertiary Average Heating Rate (° C./s) | quaternary Maintaining Temp. | Quaternary Maintaining Time | Quaternary Average Cooing Rate (° C./s) | Quintic Maintaining Temp. (° C.) | Quintic Maintaining Time (s) | Quintic Average Cooing Rate (° C./s) |
|---|---|---|---|---|---|---|---|---|
| 1 | A | 15 | 500 | 160 | 10 | 400 | 160 | 10 |
| 2 | A | 15 | 500 | 160 | 10 | 400 | 160 | 10 |
| 3 | A | 15 | 500 | 160 | 10 | 400 | 160 | 10 |
| 4 | A | 15 | 500 | 160 | 10 | 400 | 160 | 10 |
| 5 | A | 15 | 550 | 160 | 10 | 450 | 160 | 10 |
| 6 | A | 15 | 550 | 160 | 10 | 450 | 160 | 10 |
| 7 | A | 15 | 500 | 160 | 10 | 400 | 160 | 10 |
| 8 | A | 15 | 500 | 160 | 10 | 400 | 160 | 10 |
| 9 | A | 15 | 500 | 160 | 10 | 400 | 160 | 10 |
| 10 | A | 15 | 500 | 160 | 10 | 400 | 160 | 10 |
| 11 | A | 15 | 500 | 160 | 10 | 400 | 160 | 10 |
| 12 | A | 15 | 500 | 160 | 10 | 400 | 160 | 10 |
| 13 | A | 15 | 500 | 160 | 10 | 400 | 160 | 10 |

TABLE 6-continued

| Specimen No. | Steel Type | Tertiary Average Heating Rate (° C./s) | quaternary Maintaining Temp. | Quaternary Maintaining Time | Quaternary Average Cooing Rate (° C./s) | Quintic Maintaining Temp. (° C.) | Quintic Maintaining Time (s) | Quintic Average Cooing Rate (° C./s) |
|---|---|---|---|---|---|---|---|---|
| 14 | A | 15 | 500 | 160 | 10 | 400 | 160 | 10 |
| 15 | A | 15 | 370 | 160 | 10 | 400 | 160 | 10 |
| 16 | A | 15 | 630 | 160 | 10 | 400 | 160 | 10 |
| 17 | A | 15 | 500 | 3 | 10 | 400 | 160 | 10 |
| 18 | A | 15 | 500 | 160 | 10 | 270 | 160 | 10 |
| 19 | A | 15 | 550 | 160 | 10 | 520 | 160 | 10 |
| 20 | A | 15 | 500 | 160 | 10 | 400 | 3 | 10 |
| 21 | B | 15 | 500 | 160 | 10 | 400 | 160 | 10 |
| 22 | C | 15 | 500 | 160 | 10 | 400 | 160 | 10 |
| 23 | D | 15 | 500 | 160 | 10 | 450 | 160 | 10 |
| 24 | E | 15 | 550 | 160 | 10 | 450 | 160 | 10 |
| 25 | F | 15 | 550 | 160 | 10 | 400 | 160 | 10 |
| 26 | G | 15 | 500 | 160 | 10 | 400 | 160 | 10 |
| 27 | H | 15 | 500 | 160 | 10 | 350 | 160 | 10 |
| 28 | I | 15 | 450 | 160 | 10 | 350 | 160 | 10 |
| 29 | J | 15 | 450 | 160 | 10 | 400 | 160 | 10 |
| 30 | K | 15 | 500 | 160 | 10 | 400 | 160 | 10 |

TABLE 7

| Specimen No. | Steel Type | Tertiary Average Heating Rate | quaternary Maintaining Temp. | Quaternary Maintaining Time | Quaternary Average Cooing Rate (° C./s) | Quintic Maintaining Temp. | Quintic Maintaining Time | Quintic Average Cooing Rate (° C./s) |
|---|---|---|---|---|---|---|---|---|
| 31 | L | 15 | 500 | 160 | 10 | 400 | 160 | 10 |
| 32 | M | 15 | 500 | 160 | 10 | 450 | 160 | 10 |
| 33 | N | 15 | 550 | 160 | 10 | 450 | 160 | 10 |
| 34 | O | 15 | 550 | 160 | 10 | 400 | 160 | 10 |
| 35 | P | 15 | 500 | 160 | 10 | 400 | 160 | 10 |
| 36 | O | 15 | 500 | 160 | 10 | 400 | 160 | 10 |
| 37 | R | 15 | 500 | 160 | 10 | 350 | 160 | 10 |
| 38 | S | 15 | 450 | 160 | 10 | 350 | 160 | 10 |
| 39 | T | 15 | 450 | 160 | 10 | 400 | 160 | 10 |
| 40 | U | 15 | 500 | 160 | 10 | 400 | 160 | 10 |
| 41 | V | 15 | 500 | 160 | 10 | 400 | 160 | 10 |
| 42 | XA | 15 | 500 | 160 | 10 | 400 | 160 | 10 |
| 43 | XB | 15 | 500 | 160 | 10 | 400 | 160 | 10 |
| 44 | XC | 15 | 500 | 160 | 10 | 400 | 160 | 10 |
| 45 | XD | 15 | 500 | 160 | 10 | 400 | 160 | 10 |
| 46 | XE | 15 | 500 | 160 | 10 | 400 | 160 | 10 |
| 47 | XF | 15 | 550 | 160 | 10 | 450 | 160 | 10 |
| 48 | XG | 15 | 550 | 160 | 10 | 450 | 160 | 10 |
| 49 | XH | 15 | 500 | 160 | 10 | 400 | 160 | 10 |
| 50 | XI | 15 | 500 | 160 | 10 | 400 | 160 | 10 |
| 51 | XJ | 15 | 500 | 160 | 10 | 400 | 160 | 10 |
| 52 | XK | 15 | 500 | 160 | 10 | 400 | 160 | 10 |

TABLE 8

| Specimen No. | Steel Type | F (vol %) | B (vol %) | TM (vol %) | FM (vol %) | P (vol %) | V(γ) (vol %) | T(γ) (vol %) |
|---|---|---|---|---|---|---|---|---|
| 1 | A | 0 | 23 | 55 | 15 | 0 | 7 | 2.3 |
| 2 | A | 0 | 26 | 47 | 25 | 1 | 1 | 0.04 |
| 3 | A | 0 | 20 | 54 | 14 | 8 | 4 | 1.1 |
| 4 | A | 9 | 14 | 57 | 15 | 0 | 5 | 1.3 |
| 5 | A | 0 | 21 | 62 | 16 | 0 | 1 | 0.05 |
| 6 | A | 0 | 18 | 63 | 14 | 0 | 5 | 1.2 |
| 7 | A | 0 | 22 | 64 | 13 | 0 | 1 | 0.03 |
| 8 | A | 0 | 20 | 60 | 16 | 0 | 4 | 1.1 |
| 9 | A | 0 | 19 | 61 | 14 | 0 | 6 | 1.9 |
| 10 | A | 0 | 23 | 63 | 13 | 0 | 1 | 0.04 |
| 11 | A | 0 | 22 | 58 | 16 | 0 | 4 | 1 |

TABLE 8-continued

| Specimen No. | Steel Type | F (vol %) | B (vol %) | TM (vol %) | FM (vol %) | P (vol %) | V(γ) (vol %) | T(γ) (vol %) |
|---|---|---|---|---|---|---|---|---|
| 12 | A | 0 | 19 | 64 | 15 | 1 | 1 | 0.06 |
| 13 | A | 0 | 14 | 72 | 13 | 0 | 1 | 0.03 |
| 14 | A | 0 | 33 | 46 | 18 | 0 | 3 | 0.8 |
| 15 | A | 0 | 21 | 59 | 17 | 0 | 3 | 0.6 |
| 16 | A | 0 | 19 | 64 | 16 | 0 | 1 | 0.05 |
| 17 | A | 0 | 20 | 62 | 14 | 0 | 4 | 0.7 |
| 18 | A | 0 | 22 | 58 | 13 | 1 | 6 | 1.4 |
| 19 | A | 0 | 21 | 62 | 16 | 0 | 1 | 0.03 |
| 20 | A | 0 | 19 | 63 | 14 | 0 | 4 | 0.8 |
| 21 | B | 0 | 20 | 59 | 15 | 0 | 6 | 1.6 |
| 22 | C | 0 | 19 | 56 | 17 | 0 | 8 | 2 |
| 23 | D | 0 | 18 | 59 | 16 | 0 | 7 | 2.3 |
| 24 | E | 0 | 20 | 58 | 15 | 0 | 7 | 1.8 |
| 25 | F | 0 | 21 | 57 | 17 | 0 | 5 | 1.4 |
| 26 | G | 0 | 19 | 60 | 13 | 0 | 8 | 2.5 |
| 27 | H | 0 | 22 | 56 | 15 | 0 | 7 | 1.6 |
| 28 | I | 0 | 20 | 59 | 16 | 0 | 5 | 1.2 |
| 29 | J | 0 | 17 | 61 | 14 | 0 | 8 | 1.7 |
| 30 | K | 0 | 19 | 60 | 15 | 0 | 6 | 1.5 |

TABLE 9

| Specimen No. | Steel Type | F (vol %) | B (vol %) | TM (vol %) | FM (vol %) | P (vol %) | V(γ) (vol %) | T(γ) (vol %) |
|---|---|---|---|---|---|---|---|---|
| 31 | L | 0 | 23 | 58 | 13 | 1 | 5 | 1.2 |
| 32 | M | 0 | 21 | 56 | 16 | 0 | 7 | 1.3 |
| 33 | N | 0 | 19 | 59 | 14 | 0 | 8 | 2.4 |
| 34 | O | 0 | 17 | 62 | 15 | 0 | 6 | 2.1 |
| 35 | P | 0 | 20 | 60 | 13 | 0 | 7 | 1.6 |
| 36 | Q | 0 | 21 | 58 | 16 | 0 | 5 | 1.4 |
| 37 | R | 0 | 19 | 60 | 15 | 0 | 6 | 1.9 |
| 38 | S | 0 | 22 | 57 | 17 | 0 | 4 | 1.1 |
| 39 | T | 0 | 20 | 58 | 14 | 0 | 8 | 2.3 |
| 40 | U | 0 | 18 | 59 | 16 | 0 | 7 | 2.5 |
| 41 | V | 0 | 22 | 60 | 13 | 0 | 5 | 1.2 |
| 42 | XA | 0 | 21 | 58 | 15 | 0 | 6 | 1.5 |
| 43 | XB | 0 | 13 | 42 | 33 | 0 | 12 | 1.9 |
| 44 | XC | 0 | 24 | 62 | 13 | 0 | 1 | 0.03 |
| 45 | XD | 0 | 13 | 51 | 32 | 0 | 4 | 0.6 |
| 46 | XE | 0 | 12 | 54 | 31 | 0 | 3 | 0.4 |
| 47 | XF | 0 | 19 | 59 | 14 | 7 | 1 | 0.04 |
| 48 | XG | 0 | 14 | 51 | 31 | 0 | 4 | 0.8 |
| 49 | XH | 0 | 12 | 52 | 32 | 0 | 4 | 0.7 |
| 50 | XI | 0 | 13 | 53 | 31 | 0 | 3 | 0.4 |
| 51 | XJ | 0 | 22 | 59 | 15 | 0 | 4 | 0.6 |
| 52 | XK | 0 | 20 | 61 | 16 | 0 | 3 | 0.5 |

TABLE 10

| No. | Steel Type | $[B]_{FM}/[B]_{TM}$ | V(1.2 μm, γ)/V (γ) | V(lath, γ)/V(γ) | T (γ)/V(γ) | $B_{TE}$ ($10^6$ $MPa^{2\%1/2}$) | $B_{TH}$ ($10^6$ $MPa^{2\%1/2}$) | 1-YR |
|---|---|---|---|---|---|---|---|---|
| 1 | A | 0.33 | 0.23 | 0.74 | 0.33 | 5.1 | 8.6 | 0.38 |
| 2 | A | 0.17 | 0.18 | 0.56 | 0.04 | 2.7 | 4.8 | 0.23 |
| 3 | A | 0.59 | 0.19 | 0.63 | 0.28 | 1.5 | 5.2 | 0.45 |
| 4 | A | 0.24 | 0.21 | 0.58 | 0.26 | 2.2 | 4.4 | 0.32 |
| 5 | A | 0.07 | 0.17 | 0.54 | 0.05 | 2.4 | 5.5 | 0.17 |
| 6 | A | 0.15 | 0.05 | 0.57 | 0.24 | 4.0 | 5.0 | 0.15 |
| 7 | A | 0.19 | 0.16 | 0.44 | 0.03 | 2.6 | 4.9 | 0.28 |
| 8 | A | 0.22 | 0.03 | 0.32 | 0.28 | 5.5 | 3.7 | 0.24 |
| 9 | A | 0.20 | 0.07 | 0.64 | 0.32 | 5.8 | 4.5 | 0.22 |
| 10 | A | 0.18 | 0.20 | 0.41 | 0.04 | 2.3 | 5.6 | 0.30 |
| 11 | A | 0.23 | 0.06 | 0.39 | 0.25 | 4.7 | 4.1 | 0.27 |
| 12 | A | 0.06 | 0.24 | 0.56 | 0.06 | 1.9 | 5.2 | 0.23 |
| 13 | A | 0.21 | 0.05 | 0.59 | 0.03 | 2.0 | 3.5 | 0.21 |
| 14 | A | 0.17 | 0.16 | 0.60 | 0.27 | 2.4 | 4.7 | 0.34 |

TABLE 10-continued

| No. | Steel Type | $[B]_{FM}/[B]_{TM}$ | V(1.2 μm, γ)/V (γ) | V(lath, γ)/V(γ) | T (γ)/V(γ) | $B_{TE}$ ($10^6$ $MPa^{2\%1/2}$) | $B_{TH}$ ($10^6$ $MPa^{2\%1/2}$) | 1-YR |
|---|---|---|---|---|---|---|---|---|
| 15 | A | 0.15 | 0.07 | 0.72 | 0.20 | 4.6 | 5.7 | 0.33 |
| 16 | A | 0.22 | 0.05 | 0.53 | 0.05 | 2.8 | 4.5 | 0.25 |
| 17 | A | 0.20 | 0.06 | 0.58 | 0.18 | 4.5 | 3.2 | 0.28 |
| 18 | A | 0.26 | 0.07 | 0.64 | 0.23 | 3.9 | 3.1 | 0.23 |
| 19 | A | 0.23 | 0.04 | 0.55 | 0.03 | 2.5 | 5.2 | 0.37 |
| 20 | A | 0.31 | 0.06 | 0.63 | 0.20 | 3.7 | 4.6 | 0.24 |
| 21 | B | 0.28 | 0.22 | 0.59 | 0.27 | 4.3 | 7.1 | 0.18 |
| 22 | C | 0.19 | 0.18 | 0.62 | 0.25 | 4.6 | 8.5 | 0.25 |
| 23 | D | 0.16 | 0.33 | 0.70 | 0.33 | 5.9 | 8.7 | 0.22 |
| 24 | E | 0.44 | 0.25 | 0.74 | 0.26 | 5.0 | 9.5 | 0.36 |
| 25 | F | 0.53 | 0.18 | 0.81 | 0.28 | 6.1 | 10.3 | 0.42 |
| 26 | G | 0.06 | 0.13 | 0.56 | 0.31 | 3.5 | 8.5 | 0.38 |
| 27 | H | 0.18 | 0.29 | 0.58 | 0.23 | 3.9 | 10.4 | 0.15 |
| 28 | I | 0.25 | 0.45 | 0.63 | 0.24 | 4.2 | 11.3 | 0.18 |
| 29 | J | 0.36 | 0.34 | 0.67 | 0.21 | 5.8 | 7.6 | 0.21 |
| 30 | K | 0.48 | 0.19 | 0.54 | 0.25 | 4.6 | 9.5 | 0.23 |

TABLE 11

| No. | Steel Type | $[B]_{FM}/[B]_{TM}$ | V(1.2 μm, γ)/V (γ) | V(lath, γ)/V(γ) | T (γ)/V(γ) | $B_{TE}$ ($10^6$ $MPa^{2\%1/2}$) | $B_{TH}$ ($10^6$ $MPa^{2\%1/2}$) | 1-YR |
|---|---|---|---|---|---|---|---|---|
| 31 | L | 0.28 | 0.24 | 0.69 | 0.24 | 4.5 | 7.6 | 0.24 |
| 32 | M | 0.52 | 0.26 | 0.56 | 0.19 | 3.6 | 9.4 | 0.22 |
| 33 | N | 0.05 | 0.19 | 0.62 | 0.30 | 4.3 | 8.5 | 0.40 |
| 34 | O | 0.18 | 0.18 | 0.58 | 0.35 | 5.8 | 8.3 | 0.39 |
| 35 | P | 0.15 | 0.31 | 0.54 | 0.23 | 4.6 | 7.5 | 0.36 |
| 36 | Q | 0.23 | 0.28 | 0.57 | 0.28 | 3.2 | 6.3 | 0.18 |
| 37 | R | 0.30 | 0.22 | 0.65 | 0.32 | 4.7 | 11.3 | 0.17 |
| 38 | S | 0.33 | 0.35 | 0.68 | 0.28 | 4.1 | 7.7 | 0.35 |
| 39 | T | 0.42 | 0.16 | 0.71 | 0.29 | 4.8 | 8.9 | 0.31 |
| 40 | U | 0.38 | 0.14 | 0.66 | 0.36 | 3.3 | 8.4 | 0.26 |
| 41 | V | 0.29 | 0.22 | 0.63 | 0.24 | 3.9 | 9.7 | 0.24 |
| 42 | XA | 0.24 | 0.24 | 0.58 | 0.25 | 2.6 | 3.4 | 0.25 |
| 43 | XB | 0.25 | 0.18 | 0.55 | 0.16 | 2.4 | 4.7 | 0.21 |
| 44 | XC | 0.18 | 0.19 | 0.45 | 0.03 | 1.9 | 5.7 | 0.30 |
| 45 | XD | 0.16 | 0.14 | 0.57 | 0.15 | 2.2 | 4.2 | 0.26 |
| 46 | XE | 0.27 | 0.17 | 0.56 | 0.13 | 1.5 | 5.4 | 0.33 |
| 47 | XF | 0.22 | 0.15 | 0.43 | 0.04 | 2.0 | 4.8 | 0.18 |
| 48 | XG | 0.19 | 0.21 | 0.58 | 0.20 | 2.6 | 5.6 | 0.23 |
| 49 | XH | 0.16 | 0.23 | 0.61 | 0.18 | 1.8 | 4.3 | 0.25 |
| 50 | XI | 0.18 | 0.18 | 0.57 | 0.13 | 1.6 | 3.9 | 0.28 |
| 51 | XJ | 0.57 | 0.17 | 0.59 | 0.15 | 3.3 | 6.4 | 0.45 |
| 52 | XK | 0.01 | 0.22 | 0.62 | 0.17 | 3.8 | 6.7 | 0.12 |

As shown in Tables 1 to 11 above, it could be seen that in the case of the specimens complying with the conditions presented in the present invention, all of relational expressions 1 to 4 are satisfied, a balance ($B_{TE}$) of tensile strength and elongation satisfies $3.0*10^6$ to $6.2*10^6$ ($MPa^2\%^{1/2}$), a balance ($B_{TH}$) of tensile strength and a hole expansion ratio satisfies $6.0*10^6$ to $11.5*10^6$ ($MPa^2\%^{1/2}$), and a yield ratio evaluation index ($I_{YR}$) satisfies 0.15 to 0.42.

In specimen 2, the primary average heating rate was less than 5° C./s, so that tempered martensite and retained austenite were insufficient. As a results, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 2.

In specimen 3, the secondary average heating rate was more than 5° C./s, so that lump austenite was formed, and boron (B) was not concentrated into tempered martensite. As a result, $[B]_{FM}/[B]_{TM}$ was more than 0.55, a yield ratio evaluation index ($I_{YR}$) was more than 0.42, a balance ($B_{TE}$) of tensile strength and elongation was less than $3.0*10^6$, and a balance ($B_{TH}$) of tensile strength and a hole expansion ratio was less than $6.0*10^6$, in specimen 3.

In specimen 4, the primary maintaining temperature was in a two-phase region less than Ac3, so that a fraction of ferrite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 4.

In specimen 5, the primary average cooling rate was less than 2° C./s, so that a fraction of retained austenite was insufficient. As a result, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 5.

In specimen 6, the secondary maintaining temperature was less than 400° C., so that a heat treatment temperature was insufficient. As a result, V(1.2 μm, γ)/V(γ) was less than 0.12, and a balance ($B_{TH}$) of tensile strength and a hole expansion ratio was less than $6.0*10^6$, in specimen 6.

In specimen 7 the secondary maintaining temperature was more than 600° C., so that a fraction of retained austenite was insufficient. As a result, V(lath, γ)/V(γ) was less than 0.5, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 7.

In specimen 8, the secondary maintaining time was less than 5 seconds, so that a heat treatment temperature was insufficient. As a result, V(1.2 μm, γ)/V(γ) was less than 0.12, V(lath, γ)/V(γ) was less than 0.5, and a balance ($B_{TH}$) of tensile strength and a hole expansion ratio was less than $6.0*10^6$, in specimen 8.

In specimen 9, the tertiary maintaining temperature was less than 300° C., so that so that a heat treatment temperature was insufficient. As a result, V(1.2 μm, γ)/V(γ) was less than 0.12, and a balance ($B_{TH}$) of tensile strength and a hole expansion ratio was less than $6.0*10^6$, in specimen 9.

In specimen 10, the tertiary maintaining temperature was more than 500° C./s, so that a fraction of retained austenite was insufficient. As a result, V(lath, γ)/V(γ) was less than 0.5, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 10.

In specimen 11, the tertiary maintaining time was less than 5 seconds, so that a heat treatment temperature was insufficient. As a result, V(1.2 μm, γ)/V(γ) was less than 0.12, V(lath, γ)/V(γ) was less than 0.5, a balance ($B_{TH}$) of tensile strength and a hole expansion ratio was less than $6.0*10^6$, in specimen 11.

In specimen 12, the tertiary average cooling rate was less than 2° C., so that a fraction of retained austenite was insufficient. As a result, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 12.

In specimen 13, the primary cooling stop temperature was less than 200° C., so that a fraction of tempered martensite was excessive, and a fraction of retained austenite was insufficient. As a result, V(1.2 μm, γ)/V(γ) was less than 0.12, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 13.

In specimen 14, the primary cooling stop temperature was more than 400° C., so that a fraction of bainite was excessive, and a fraction of tempered martensite was insufficient. As a result, a balance ($B_{TE}$) of tensile strength and elongation was less than $3.0*10^6$, and a balance ($B_{TH}$) of tensile strength and a hole expansion ratio was less than $6.0*10^6$, in specimen 14.

In specimen 15, the quaternary maintaining temperature was less than 400° C., so that so that a heat treatment temperature was insufficient. As a result, V(1.2 μm, γ)/V(γ) was less than 0.12, and a balance ($B_{TH}$) of tensile strength and a hole expansion ratio was less than $6.0*10^6$, in specimen 15.

In specimen 16, the quaternary maintaining temperature was more than 600° C., so that a fraction of retained austenite was insufficient. As a result, V(1.2 μm, γ)/V(γ) was less than 0.12, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 16.

In specimen 17, the quaternary maintaining time was less than 10 seconds, so that a heat treatment time was insufficient. As a result, V(1.2 μm, γ)/V(γ) was less than 0.12, and a balance ($B_{TH}$) of tensile strength and a hole expansion ratio was less than $6.0*10^6$, in specimen 17.

In specimen 18, the quintic maintaining temperature was less than 300° C., so that so that a heat treatment temperature was insufficient. As a result, V(1.2 μm, γ)/V(γ) was less than 0.12, and a balance ($B_{TH}$) of tensile strength and a hole expansion ratio was less than $6.0*10^6$, in specimen 18.

In specimen 19, the quintic maintaining temperature was more than 500° C., so that a fraction of retained austenite was insufficient. As a result, V(1.2 μm, γ)/V(γ) was less than 0.12, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 19.

In specimen 20, the quintic maintaining time was less than 10 seconds, so that a heat treatment time was insufficient. As a result, V(1.2 μm, γ)/V(γ) was less than 0.12, and a balance ($B_{TH}$) of tensile strength and a hole expansion ratio was less than $6.0*10^6$, in specimen 20.

In specimen 42, a content of carbon (C) was low, so that a balance ($B_{TE}$) of tensile strength and elongation was less than $3.0*10^6$, and a balance ($B_{TH}$) of tensile strength and a hole expansion ratio was less than $6.0*10^6$.

In specimen 43, a content of carbon (C) was high, so that a fraction of tempered martensite was insufficient, and a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 43.

In specimen 44, a content of silicon (Si) was low, so that a fraction of retained austenite was insufficient. As a result, V(lath, γ)/V(γ) was less than 0.5, T(γ)/V(γ) was less than 0.08, a balance ($B_{TE}$) of tensile strength and elongation was less than $3.0*10^6$, and a balance ($B_{TH}$) of tensile strength and a hole expansion ratio was less than $6.0*10^6$, in specimen 44.

In specimen 45, a content of silicon (Si) was high, so that a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 45.

In specimen 46, a content of Aluminum (Al) was high, so that a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 46.

In specimen 47, a content of manganese (Mn) was low, so that pearlite was generated, and a fraction of retained austenite was insufficient. As a result, V(lath, γ)/V(γ) was less than 0.5, T(γ)/V(γ) was less than 0.08, a balance ($B_{TE}$) of tensile strength and elongation was less than $3.0*10^6$, in specimen 47.

In specimen 48, a content of manganese (Mn) was high, so that a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 48.

In specimen 49, a content of chromium (Cr) was high, so that a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 49.

In specimen 50, a content of molybdenum (Mo) was high, so that a fraction of fresh martensite was excessive. As a result, a balance ($B_{TE}$) of tensile strength and elongation was less than $3.0*10^6$, and a balance ($B_{TH}$) of tensile strength and a hole expansion ratio was less than $6.0*10^6$, in specimen 50.

In specimen 51, a content of boron (B) was low, so that boron (B) was not concentrated into tempered martensite. As a result, $[B]_{FM}/[B]_{TM}$ was more than 0.55, and a yield ratio evaluation index ($I_{YR}$) was more than 0.42, in specimen 51.

In specimen 52, a content of boron (B) was high, so that boron (B) was excessively concentrated into tempered martensite. As a result, $[B]_{FM}/[B]_{TM}$ was less than 0.03, and a yield ratio evaluation index ($I_{YR}$) was less than 0.15, in specimen 52.

While the present invention has been described in detail through exemplary embodiment, other types of exemplary embodiments are also possible. Therefore, the technical spirit and scope of the claims set forth below are not limited to exemplary embodiments.

The invention claimed is:

1. A high strength steel sheet having excellent workability, comprising:

by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities; and includes, as microstructures, bainite, tempered martensite, fresh martensite, retained austenite and unavoidable structures, wherein the high strength steel sheet satisfies the following relational expressions 1 to 4:

$$0.03 \le [B]_{FM}/[B]_{TM} \le 0.55 \quad \text{[Relational Expression 1]}$$

where $[B]_{FM}$ is a content (wt %) of Boron (B) contained in the fresh martensite, and $[B]_{TM}$ is a content (wt %) of Boron (B) contained in the tempered martensite;

$$V(1.2\ \mu m, \gamma)/V(\gamma) \ge 0.12 \quad \text{[Relational Expression 2]}$$

where V(1.2 μm, γ) is a fraction (vol %) of the retained austenite having an average grain size of 1.2 μm or more, and V(γ) is a fraction (vol %) of the retained austenite of the steel sheet;

$$V(\text{lath}, \gamma)/V(\gamma) \ge 0.5 \quad \text{[Relational Expression 3]}$$

where V(lath, γ) is a fraction (vol %) of the retained austenite in lath form, and V(γ) is a fraction (vol %) of the retained austenite of the steel sheet; and $$T(\gamma)/V(\gamma) \ge 0.08 \quad \text{[Relational Expression 4]}$$

where T(γ) is a fraction (vol %) of tempered retained austenite of the steel sheet, and V(γ) is a fraction (vol %) of the retained austenite of the steel sheet.

2. The high strength steel sheet having excellent workability of claim 1, further comprising:

by wt %, one or more of the following (1) to (8):

(1) one or more of Ti: 0 to 0.5%, Nb: 0 to 0.5%, and V: 0 to 0.5%;

(2) one or more of Cr: 0 to 3.0% and Mo: 0 to 3.0%;

(3) one or more of Cu: 0 to 4.0% and Ni: 0 to 4.0%;

(4) one or more of Ca: 0 to 0.05%, REM: 0 to 0.05% excluding Y, and Mg: 0 to 0.05%;

(5) one or more of W: 0 to 0.5% and Zr: 0 to 0.5%;

(6) one or more of Sb: 0 to 0.5% and Sn: 0 to 0.5%;

(7) one or more of Y: 0 to 0.2% and Hf: 0 to 0.2%; and (8) Co: 0 to 1.5%.

3. The high strength steel sheet having excellent workability of claim 1, wherein the microstructures of the steel sheet include, by volume fraction, 10 to 30% of bainite, 50 to 70% of tempered martensite, 10 to 30% of fresh martensite, 2 to 10% of retained austenite, and 5% or less (including 0%) of ferrite.

4. The high strength steel sheet having excellent workability of claim 1, wherein a balance ($B_{TE}$) of tensile strength and elongation expressed by the following relational expression 5 satisfies $3.0*10^6$ to $6.2*10^6$ ($MPa^2\%^{1/2}$), a balance ($B_{TH}$) of tensile strength and a hole expansion ratio expressed by the following relational expression 6 satisfies $6.0*10^6$ to $11.5*10^6$ ($MPa^2\%^{1/2}$), and a yield ratio evaluation index ($I_{YR}$) expressed by the following relational expression 7 satisfies 0.15 to 0.42:

$$B_{TE} = [\text{Tensile Strength } (TS, MPa)]^2 * [\text{Elongation } (El, \%)]^{1/2}; \quad \text{[Relational Expression 5]}$$

$$B_{TH} = [\text{Tensile Strength } (TS, MPa)]^2 * [\text{Hole Expansion Ratio } (HER, \%)]^{1/2}; \text{ and} \quad \text{[Relational Expression 6]}$$

$$I_{YR} = 1 - [\text{Yield Ratio } (YR)]. \quad \text{[Relational Expression 7]}$$

5. A method for manufacturing a high strength steel sheet having excellent workability, the method comprising:

providing a cold-rolled steel sheet including, by wt %, C: 0.1 to 0.25%, Si: 0.01 to 1.5%, Mn: 1.0 to 4.0%, Al: 0.01 to 1.5%, P: 0.15% or less, S: 0.03% or less, N: 0.03% or less, B: 0.0005 to 0.005%, a balance of Fe, and unavoidable impurities;

heating (primary heating) the cold-rolled steel sheet to a temperature of 700° C. at an average heating rate of 5° C./s or more, heating (secondary heating) the primarily heated steel sheet to a temperature within a range of Ac3 to 920° C. at an average heating rate of 5° C./s or less, and then maintaining (primary maintaining) the secondarily heated steel sheet for 50 to 1200 seconds;

cooling (primary cooling) the primarily maintained steel sheet to a temperature within a range of 400 to 600° C. at an average cooling rate of 2 to 100° C./s, and then maintaining (secondary maintaining) the primarily cooled steel sheet for 5 to 600 seconds;

cooling (secondary cooling) the secondarily maintained steel sheet to a temperature within a range of 300 to 500° C. at an average cooling rate of 1 to 100° C./s, and then maintaining (tertiary maintaining) the secondarily cooled steel sheet for 5 to 600 seconds;

cooling (tertiary cooling) the tertiarily maintained steel sheet to a temperature within a range of 200 to 400° C. at an average cooling rate of 2 to 100° C./s;

heating (tertiary heating) the tertiarily cooled steel sheet to a temperature within a range of 400 to 600° C. at an average heating rate of 5 to 100° C./s, and then maintaining (quaternary maintaining) the tertiarily heated steel sheet for 10 to 1800 seconds;

cooling (quaternary cooling) the quaternarily maintained steel sheet to a temperature within a range of 300 to 500° C. at an average cooling rate of 1 to 100° C./s, and then maintaining (quintically maintaining) the quaternarily cooled steel sheet for 10 to 1800 seconds; and cooling (quintically cooling) the quintically maintained steel sheet to room temperature at an average cooling rate of 1° C./s or more.

6. The method for manufacturing a high strength steel sheet having excellent workability of claim 5, wherein the steel slab further includes one or more of the following (1) to (8):

(1) one or more of Ti: 0 to 0.5%, Nb: 0 to 0.5%, and V: 0 to 0.5%;

(2) one or more of Cr: 0 to 3.0% and Mo: 0 to 3.0%;

(3) one or more of Cu: 0 to 4.0% and Ni: 0 to 4.0%;

(4) one or more of Ca: 0 to 0.05%, REM: 0 to 0.05% excluding Y, and Mg: 0 to 0.05%;
(5) one or more of W: 0 to 0.5% and Zr: 0 to 0.5%;
(6) one or more of Sb: 0 to 0.5% and Sn: 0 to 0.5%;
(7) one or more of Y: 0 to 0.2% and Hf: 0 to 0.2%; and
(8) Co: 0 to 1.5%.

7. The method for manufacturing a high strength steel sheet having excellent workability of claim 5, wherein the cold-rolled steel sheet is provided by:

heating steel slab to 1000 to 1350° C.;

performing finishing hot rolling at a temperature within a range of 800 to 1000° C.;

coiling the hot-rolled steel sheet at a temperature within a range of 350 to 600° C.;

pickling the coiled steel sheet; and cold rolling the pickled steel sheet at a reduction ratio of 30 to 90%.

8. The method for manufacturing a high strength steel sheet having excellent workability of claim 5, wherein the cooling rate (Vc1) of the primary cooling and the cooling rate (Vc4) of the quaternary cooling satisfies a relation of Vc1>Vc4.

* * * * *